US011499258B2

(12) United States Patent
Dayan

(10) Patent No.: US 11,499,258 B2
(45) Date of Patent: Nov. 15, 2022

(54) WETSUIT WASHING DEVICE

(71) Applicant: M.A.S. Bully Ltd., Ramat Gan (IL)

(72) Inventor: Maor Dayan, Ramat Gan (IL)

(73) Assignee: M.A.S. BULLY LTD., Ramat Gan (IL)

( * ) Notice: Subject to any disclaimer, the term of this patent is extended or adjusted under 35 U.S.C. 154(b) by 359 days.

(21) Appl. No.: 16/644,548

(22) PCT Filed: Aug. 30, 2018

(86) PCT No.: PCT/IL2018/050960
§ 371 (c)(1),
(2) Date: Mar. 5, 2020

(87) PCT Pub. No.: WO2019/049128
PCT Pub. Date: Mar. 14, 2019

(65) Prior Publication Data

US 2020/0263338 A1 Aug. 20, 2020

Related U.S. Application Data

(60) Provisional application No. 62/554,036, filed on Sep. 5, 2017.

(51) Int. Cl.

| | |
|---|---|
| ***D06F 17/04*** | (2006.01) |
| ***A47G 25/20*** | (2006.01) |
| ***D06B 1/02*** | (2006.01) |
| ***A47G 25/14*** | (2006.01) |

(Continued)

(52) U.S. Cl.
CPC ..... *D06F 17/04* (2013.01); *A47G 25/20* (2013.01); *D06B 1/02* (2013.01); *A47G 2025/1485* (2013.01); *B63C 11/02* (2013.01); *B63C 11/04* (2013.01); *B63C 2011/046* (2013.01); *D06B 2700/36* (2013.01)

(58) Field of Classification Search
CPC .. A47G 2025/1485; D06F 41/00; D06B 1/02; B63C 11/02
USPC ..... 134/115 R
See application file for complete search history.

(56) References Cited

U.S. PATENT DOCUMENTS 4,949,739 A * 8/1990 Ryan ..... D06F 41/00 134/201
4,989,624 A * 2/1991 Darling ..... D06F 17/04 D6/318

(Continued)

*Primary Examiner* — F Griffin Hall
(74) *Attorney, Agent, or Firm* — Mark M. Friedman

(57) ABSTRACT

A first irrigation assembly includes a base plate having an upwardly curved sidewall and a planar annular peripheral flange. Spray outlets on the upwardly curved sidewall provide liquid spray to exterior portions of a wetsuit at a plurality of spray angles. Spray outlets on the annular peripheral flange provide liquid spray to exterior portions of the wetsuit at spray angles different from the spray angles of the spray outlets on the upwardly curved sidewall. A second irrigation assembly includes first and second curved pipes and an upper piping arrangement having major external surfaces. First and second flow junctions provide fluid flow connection between the curved pipes and the upper piping arrangement. Spray outlets arranged along the major external surfaces of the curved pipes and the upper piping arrangement provide liquid spray to upper and lower interior rear and front portions of the wetsuit.

18 Claims, 19 Drawing Sheets

(51) Int. Cl.
*B63C 11/04* (2006.01)
*B63C 11/02* (2006.01)

(56) References Cited

U.S. PATENT DOCUMENTS

| | | | | | |
|---|---|---|---|---|---|
| 4,997,000 | A * | 3/1991 | Feast | D06F 18/00 | 134/115 R |
| 5,037,487 | A * | 8/1991 | Santos | D06F 41/00 | 134/115 R |
| 7,467,737 | B1 * | 12/2008 | Bissett | A47G 25/20 | 223/85 |
| 9,532,673 | B2 * | 1/2017 | Schoonover | A47G 25/20 | |
| 9,828,713 | B2 * | 11/2017 | Dayan | D06B 1/02 | |
| 2005/0274751 | A1 * | 12/2005 | Plumley | B63C 11/02 | 223/85 |
| 2012/0291823 | A1 * | 11/2012 | Trent | D06F 58/14 | 134/115 R |

* cited by examiner

WETSUIT WASHING DEVICE

CROSS-REFERENCE TO RELATED APPLICATIONS

This application claims priority from U.S. Provisional Patent Application No. 62/554,036, filed Sep. 5, 2017, whose disclosure is incorporated by reference in its entirety herein.

TECHNICAL FIELD

The present invention relates to wetsuit cleaning devices and methods.

BACKGROUND OF THE INVENTION

Wetsuits are commonly used to provide thermal protection against cold water for a variety of activities, including, but not limited to, surfing, water skiing, scuba diving, windsurfing and the like. Wetsuits are typically made from stretchable porous fabrics such as neoprene and the like. A properly fitted wetsuit allows the user to maintain body warmth in cold water conditions by providing layered insulation between the user and the water. Wetsuits are typically exposed to a wide range of foreign objects, including, but not limited to, salt water, urine, sand, rocks and the like. It is therefore necessary to clean wetsuits with fresh water between uses to remove these foreign objects. The lack of cleaning of wetsuits between uses can lead to accelerated deterioration and corrosion of the wetsuit, thus degrading thermal protection. Furthermore, organic materials, such as bacteria and fungi and the like, can accumulate in the wetsuit if not properly cleaned. These organic materials contribute both to the corrosive effects of the wetsuit and present a health hazard to the wetsuit user. Cleaning a wetsuit with fresh water after each use increases the lifespan of the wetsuit, typically by an average of 40%-60%. Wetsuits may be cleaned using a common garden hose, shower or the like. These methods are typically not sufficiently thorough, as the porous neoprene material of the wetsuit absorbs foreign objects. Alternative methods have been presented in which a wetsuit is mounted to a hanger like device having spray outlets connected to a garden hose. However, hanger like devices may stretch and damage the wetsuit, leading to poor fitting wetsuits and reduced thermal protection. In addition, the spray outlets of such hanger like devices provide limited coverage of the interior and exterior portions of the wetsuit.

SUMMARY OF THE INVENTION

The present invention is device for washing wetsuits.

According to the teachings of an embodiment of the present invention, there is provided a device for washing a wetsuit. The device comprises: a first irrigation assembly for providing a liquid to exterior portions of the wetsuit and including a base plate having an upwardly curved sidewall and a planar annular peripheral flange, the upwardly curved sidewall including a plurality of spray outlets arranged to provide spray of the liquid to exterior portions of the wetsuit at a plurality of spray angles, and the annular peripheral flange including a plurality of spray outlets arranged to provide spray of the liquid to exterior portions of the wetsuit at spray angles different from the spray angles of the spray outlets of the upwardly curved sidewall; and a second irrigation assembly in fluid flow communication with the first irrigation assembly for providing the liquid to interior portions of the wetsuit, the second irrigation assembly including a first curved pipe having a major external surface, a second curved pipe having a major external surface, and an upper piping arrangement having a major external surface, the curved pipes and the upper piping arrangement being in fluid flow communication with each other via a first and second flow junction, the second irrigation assembly further including a plurality of spray outlets arranged along the major external surfaces of the curved pipes and the upper piping arrangement and adapted to provide spray of the liquid, at a plurality of spray angles, to an upper and lower rear interior portion of the wetsuit, and to an upper and lower front interior portion of the wetsuit.

Optionally, the curved pipes are operatively coupled to each other via respective first ends at the first flow junction and via respective second ends at the second flow junction.

Optionally, the curved pipes are operatively coupled to each other to form a substantially elliptical piping structure.

Optionally, the first curved pipe includes at least one segment that extends along a segment of the upper rear interior portion of the wetsuit, and wherein the second curved pipe includes at least one segment that extends along a segment of the upper front interior portion of the wetsuit.

Optionally, the first irrigation assembly further includes a cover assembly including an upper base plate operatively coupled to the base plate.

Optionally, cover assembly further includes a neck portion having a main intake port for receiving the liquid to be supplied to the first and second irrigation assemblies.

Optionally, the device further comprises a hook assembly that includes a hook and a rod, wherein the hook assembly is placed into communication with the first irrigation assembly via operative coupling of the rod and a connection port of the first irrigation assembly.

Optionally, the rod is rotatable, between two fixed rotation positions, about an axis of rotation that is normal to the plane of the planar annular peripheral flange.

Optionally, the hook includes a first curved interior surface and a second curved interior surface, the curved interior surfaces being separated by a flared ridge.

Optionally, the second curved interior surface extends between the flared tip and a blunt edge, wherein a tip of the hook is terminated by the blunt edge.

Optionally, the device further comprises a main body deployed to cover the second irrigation assembly, the main body including a plurality of major external surfaces that together conform in shape to the upper chest, shoulder, upper back, and lower neck portions of a human body.

There is also provided according to an embodiment of the teachings of the present invention a device for washing a wetsuit. The device comprises: a first curved pipe having a major external surface and including a first plurality of spray outlets and second plurality of spray outlets, the first plurality of spray outlets arranged along an upper portion of the major external surface and adapted to provide spray of a liquid to an upper rear interior portion of the wetsuit, the second plurality of spray outlets arranged along a lower portion of the major external surface and adapted to provide spray of the liquid to a lower rear interior portion of the wetsuit; a second curved pipe having a major external surface and including a first plurality of spray outlets and a second plurality of spray outlets, the curved pipes being operatively coupled to each other at a first flow junction and a second flow junction, the first plurality of spray outlets arranged along an upper portion of the major external surface and adapted to provide spray of the liquid to an upper front interior portion of the wetsuit, the second plurality of spray outlets arranged along a lower portion of the major external surface and adapted to provide spray of the liquid to a lower front interior portion of the wetsuit; an upper piping arrangement including at least one pipe segment operatively coupled to the curved pipes at the first and second flow junctions, the first and second flow junctions placing the curved pipes and the upper piping arrangement in fluid flow communication with each other, the upper piping arrangement including a first plurality of spray outlets arranged along the pipe segment and adapted to provide spray of the liquid to the upper rear interior portion of the wetsuit and a second plurality of spray outlets arranged along the pipe segment and adapted to provide spray of the liquid to the upper front interior portion of the wetsuit; and a base plate in fluid flow communication with the upper piping arrangement, the base plate having an upwardly curved sidewall and an annular peripheral flange, the upwardly curved sidewall including a plurality of spray outlets arranged to provide spray of the liquid to exterior portions of the wetsuit at a plurality of spray angles, and the annular peripheral flange including a plurality of spray outlets arranged to provide spray of the liquid to exterior portions of the wetsuit at spray angles different from the spray angles of the spray outlets of the upwardly curved sidewall.

Optionally, the upper piping arrangement includes an intake port for receiving the liquid to be supplied to the at least one pipe segment and the curved pipes, and wherein the liquid flows through the intake port to the pipe segment and subsequently to the curved pipes.

Optionally, the device further comprises a main intake port in fluid flow communication with the base plate for receiving the liquid to be supplied to the pluralities of spray outlets of the curved pipes, upper piping arrangement, and base plate.

Optionally, the device further comprises a main body deployed to cover segments of the curved pipes and the upper piping arrangement.

Optionally, the main body includes a first and second shoulder portion, each of the shoulder portions formed from at least one major external surface and a slot opening, wherein the slot opening of the first shoulder portion is deployed proximate to the first flow junction to allow the liquid to spray out of a subset of the spray outlets of the first plurality of spray outlets of the first and second curved pipes through the slot opening of the first shoulder portion, and wherein the slot opening of the second shoulder portion is deployed proximate to the second flow junction to allow the liquid to spray out of a subset of the spray outlets of the second plurality of spray outlets of the first and second curved pipes through the slot opening of the second shoulder portion.

There is also provided according to an embodiment of the teachings of the present invention a device for washing a wetsuit. The device comprises: a lower irrigation assembly for providing a liquid to interior portions of the wetsuit, the lower irrigation assembly including a first curved pipe, a second curved pipe, and an upper piping arrangement having at least one pipe segment, the curved pipes and the upper piping arrangement being in fluid flow communication with each other via a first and second flow junction, the lower irrigation assembly further including a plurality of spray outlets arranged along major external surfaces of the curved pipes and the at least one pipe of the upper piping arrangement; and a main body operatively coupled to the lower irrigation assembly, the main body including a first and second shoulder portion, each of the shoulder portions formed from at least one major external surface and a slot opening, wherein the slot opening of the first shoulder portion is deployed proximate to the first flow junction to allow the liquid to spray out of a first subset of the plurality of spray outlets arranged along an upper portion of the major external surface of the at least one pipe segment of the upper piping arrangement through the slot opening of the first shoulder portion, and wherein the slot opening of the second shoulder portion is deployed proximate to the second flow junction to allow the liquid to spray out of a second subset of the plurality of spray outlets arranged along an upper portion of the major external surface of the at least one pipe segment of the upper piping arrangement through the slot opening of the second shoulder portion.

Optionally, the device further comprises an upper irrigation assembly in fluid flow communication with the lower irrigation assembly and including a base plate having an upwardly curved sidewall and a planar annular peripheral flange, the upwardly curved sidewall including a plurality of spray outlets arranged to provide spray of the liquid to exterior portions of the wetsuit at a plurality of spray angles, and the annular peripheral flange including a plurality of spray outlets arranged to provide spray of the liquid to exterior portions of the wetsuit at spray angles different from the spray angles of the spray outlets of the upwardly curved sidewall.

Unless otherwise defined herein, all technical and/or scientific terms used herein have the same meaning as commonly understood by one of ordinary skill in the art to which the invention pertains. Although methods and materials similar or equivalent to those described herein may be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the present invention are herein described, by way of example only, with reference to the accompanying drawings. With specific reference to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

Attention is now directed to the drawings, where like reference numerals or characters indicate corresponding or like components. In the drawings.

DESCRIPTION OF THE PREFERRED EMBODIMENTS

Figure 1:
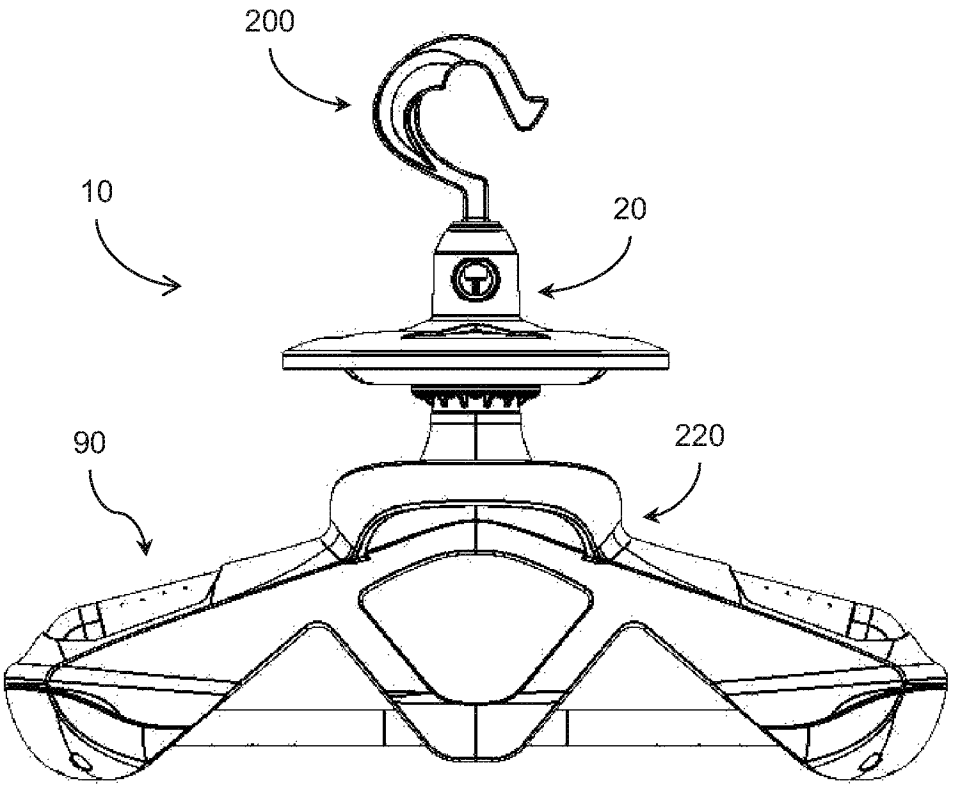
FIG. 1 is a front view of a device having an upper irrigation assembly, a lower irrigation assembly, a main body, and a hook assembly, constructed and operative according to an embodiment of the present invention, taken from behind the device.

The present invention is a device for washing wetsuits.

The principles and operation of the device according to the present invention may be better understood with reference to the drawings and accompanying description.

Before explaining at least one embodiment of the invention in detail, it is to be understood that the invention is not necessarily limited in its application to the details of construction and the arrangement of the components and/or methods set forth in the following description and/or illustrated in the drawings and/or the examples. The invention is capable of other embodiments or of being practiced or carried out in various ways. Initially, throughout this document, references are made to directions such as, for example, front and rear, top and bottom, left, and right, and the like. These directional references are exemplary only to illustrate the invention and embodiments thereof.

The device of the present disclosure may be used as a standalone hanger assembly for cleaning individual wetsuits of various size and thickness, or may be used as one of many such devices mounted to a wetsuit washing system, such as the system described in commonly owned U.S. Pat. No. 9,828,713.

Within the context of this document, the term "wetsuit" generally refers to various wearable ensembles which provide thermal insulated protection to users while immersed in water and should not be limited to a specific insulation technology.

Referring now to the drawings, FIGS. 1-4 show various views of a device, generally designated 10, constructed and implemented according to an embodiment of the present disclosure, for washing a wetsuit. Generally speaking, the device 10 has a first irrigation assembly 20 (referred to interchangeably as "upper irrigation assembly 20"), a second irrigation assembly 90 (referred to interchangeably as "lower irrigation assembly 90"), a hook assembly 200, and a main body 220. The irrigation assemblies 20, 90 are connected to each other to provide fluid flow therebetween. The individual components of the upper irrigation assembly 20 may be constructed from aluminum, steel, polyvinyl chloride (PVC), plastic, a combination thereof, or any suitable material capable of supporting the weight of lower irrigation assembly 90 and a wetsuit. The individual components of the lower irrigation assembly 90 may be constructed from aluminum, steel, PVC, plastic, a combination thereof, or any suitable material capable of supporting the weight of a wetsuit.

Figure 4:
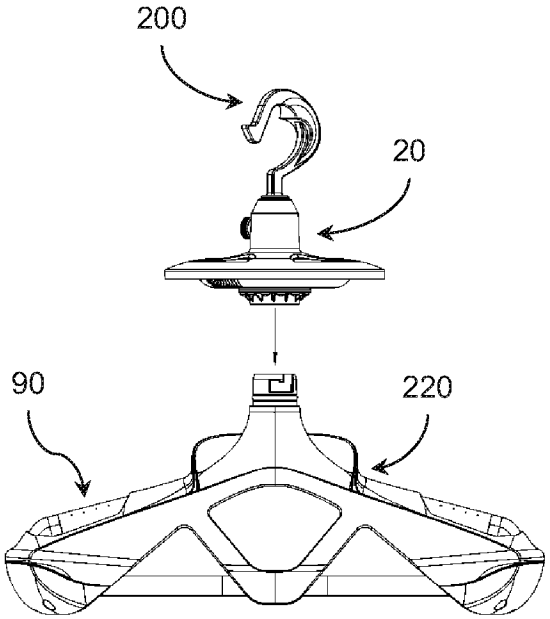
FIG. 4 is a front view of the device of FIG. 1, taken from in front of the device, showing the upper and lower irrigation assemblies separated from each other.
Figure 3:
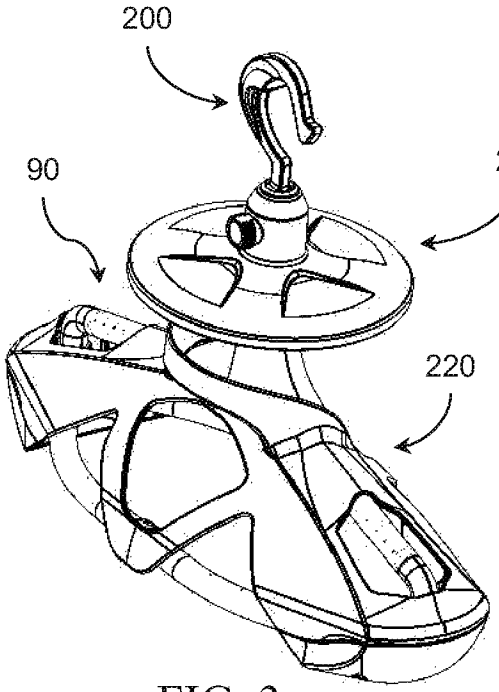
FIG. 3 is isometric view of device of FIG. 1, taken from above the device.
Figure 2:
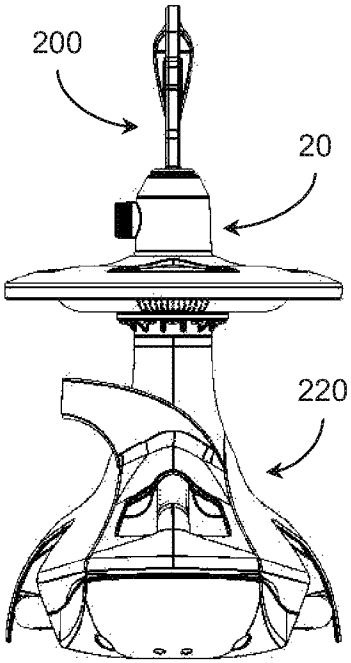
FIG. 2 is a side view of the device of FIG. 1.
Figure 6:
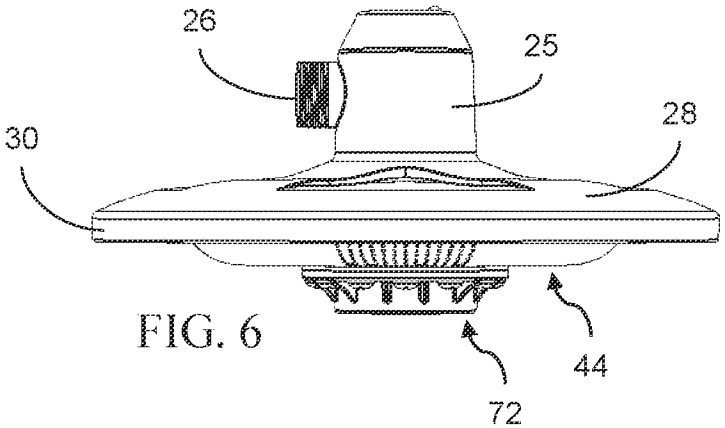
FIG. 6 is a side view of the upper irrigation assembly of FIG.5.
Figure 5:
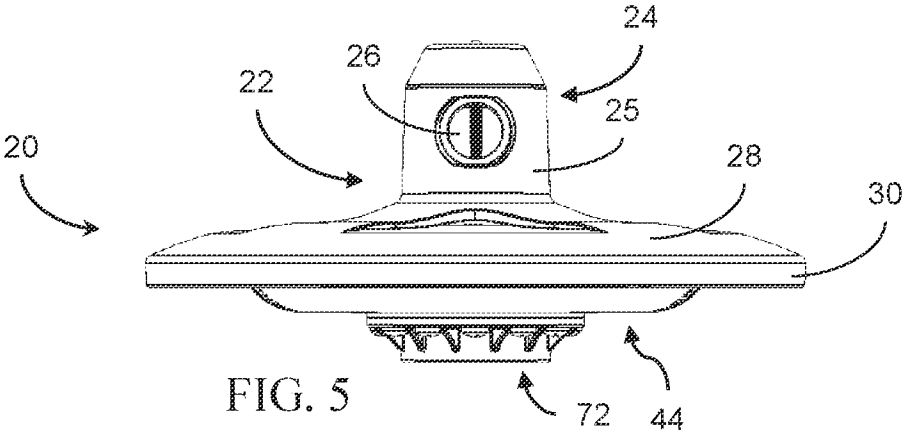
FIG. 5 is front view of the upper irrigation assembly of the device of FIG. 1.
Figure 8:
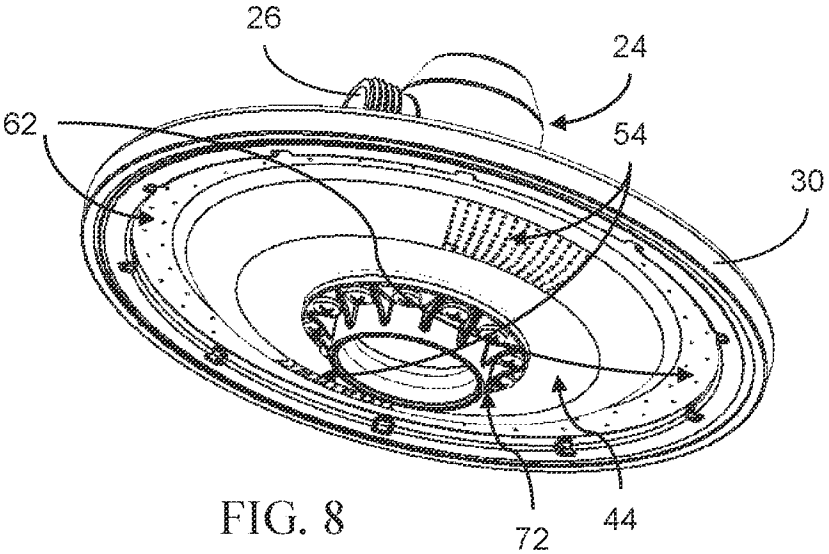
FIG. 8 is an isometric view of the upper irrigation assembly of FIG. 5, taken from below the upper irrigation assembly.

As is shown in FIG. 4, the hook assembly 200 is attached to the upper irrigation assembly 20, and the main body 220 is attached to the lower irrigation assembly 90. The main body 220 is removably attachable to the upper irrigation assembly 20, thereby providing removable attachment of the two irrigation assemblies 20 and 90.

The upper irrigation assembly 20 supplies liquid, from a liquid source, to the exterior portions of a wetsuit mounted to the main body 220 via a plurality of spray outlets arranged on various portions of the upper irrigation assembly 20. Preferably, the liquid is fresh water, supplied via a conduit (e.g., garden hose or the like) from a faucet or tap.

With continued reference to FIGS. 1-4, refer now to FIGS. 5-8, various views of the upper irrigation assembly 20. The upper irrigation assembly 20 has a cover assembly 22 connected to a lower base plate 44 via a connecting core 72. The lower base plate 44 has a first plurality of spray outlets 54 and a second plurality of spray outlets 62 arranged on various portions of the lower base plate 44. The first plurality spray outlets 54 are arranged to provide spray of the liquid to exterior portions of the wetsuit, in particular the exterior shoulder regions of the wetsuit. The second plurality of spray outlets 62 are arranged to provide spray of the liquid to exterior portions of the wetsuit, in particular the exterior chest and back regions of the wetsuit.

The cover assembly 22 has a vertical flute portion 24 having a main intake port 26 deployed on an external sidewall 25, and a connection port 27, for receiving the hook assembly 200, deployed at a terminating end of the vertical flute portion 24. The main intake port 26 is configured receive the liquid from the liquid source, and may include an adapter or the like for connecting to a common garden hose. The cover assembly 22 also has an upper base plate 28 having a downward projecting flange 30 that provides a connection interface between the cover assembly 22 and the lower base plate 44.

Figure 9:
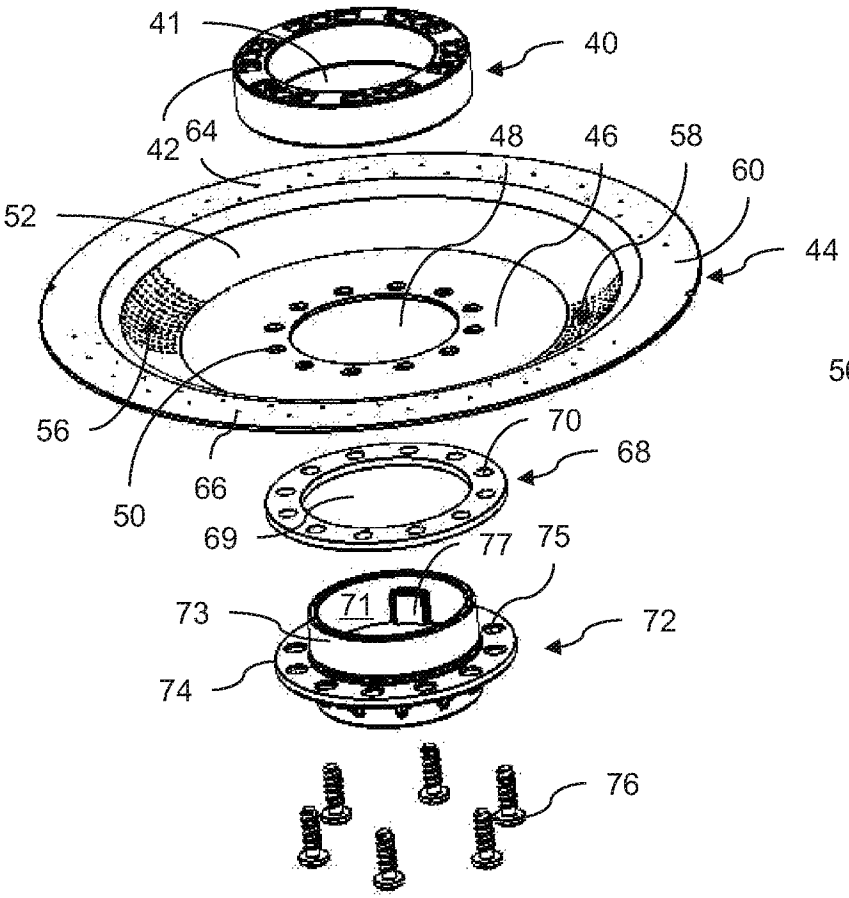
FIG. 9 is an exploded isometric view of subcomponents of the upper irrigation assembly.
Figure 12B:
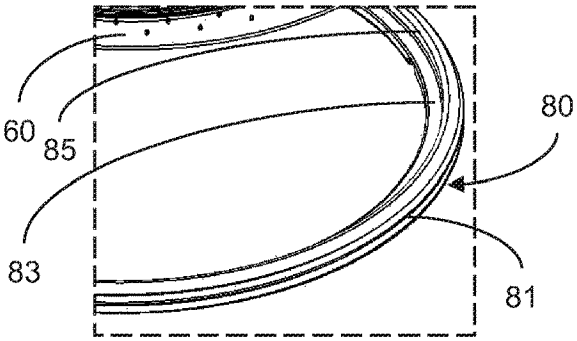
FIG. 12B is an enlarged view of the region of FIG. 12A designated XII.
Figure 12A:
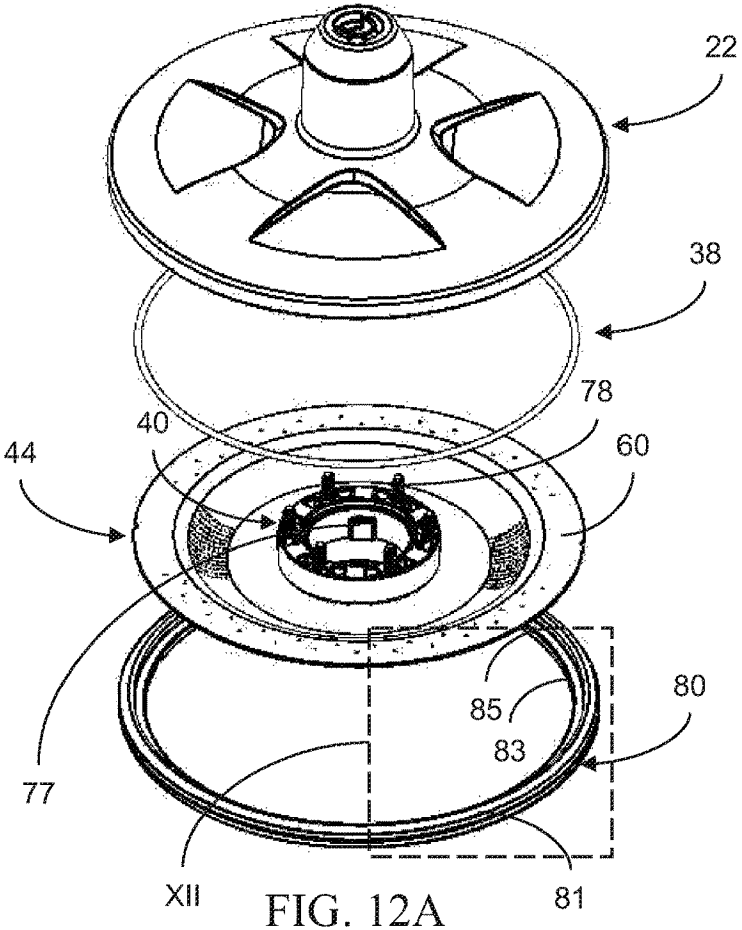
FIG. 12A is an exploded isometric view of the upper irrigation assembly.

With continued reference to the FIGS. 1-8, refer now to FIG. 9, an exploded view of subcomponents of the upper irrigation assembly 20, including the lower base plate 44. The lower base plate 44 has a central planar circular portion 46 with a central aperture 48. The connecting core 72 is mechanically fastened to the lower base plate 44 via a plurality of threaded screws 76. A plurality of threaded apertures 50 are evenly distributed around the perimeter of the central aperture 48. A first subset of the threaded apertures 50 are dimensioned to receive the threaded screws 76, while a second subset of the threaded apertures 50 are dimensioned to receive a different set of threaded screws 78 (FIG. 12A).

The connecting core 72 has a main hollow cylindrical section 73 corresponding in dimension to the central aperture 48. The cylindrical section 73 has an inner sidewall 71 with a protruding portion 77. The protruding portion 77, together with portions of the main body 220, act as an attachment mechanism for removably attaching the main body 220 to the upper irrigation assembly 20, as will be described in detail in subsequent sections of the present disclosure.

An annular peripheral flange 74 projects outwardly from the main cylindrical section. The peripheral flange 74 has a plurality of threaded apertures 75 evenly distributed about the central flange 74. A first subset of the threaded apertures 75 are dimensioned to receive the threaded screws 76, while a second subset of the threaded apertures 75 are dimensioned to receive a different set of threaded screws 78 (FIG. 12A).

A washer seal 68, generally annular in shape and having a central aperture 69 corresponding in dimension to the central aperture 48 of the lower base plate 44 and the connecting core 72, is positioned on a bottom surface of the central planar circular portion 46. The washer seal 68 has a plurality of threaded apertures 70 evenly distributed around the annular portion of the washer seal 68. Similar to the threaded apertures 75 of the connecting core 72, a first subset of the threaded apertures 70 are dimensioned to receive the threaded screws 76, while a second subset of the threaded apertures 70 are dimensioned to receive a different set of threaded screws 78 (FIG. 12A). In certain embodiments, the washer seal 68 is constructed from neoprene.

The upper portion of the main cylindrical section 73 (i.e., the portion above the peripheral flange 74) is inserted through the aligned central apertures 48 and 69 until the top surface of the peripheral flange 74 abuts the bottom surface of the washer seal 68. When inserted, the threaded apertures 70 of the washer seal 68 are aligned with the threaded apertures 75 of the connecting core 72.

Figure 10:
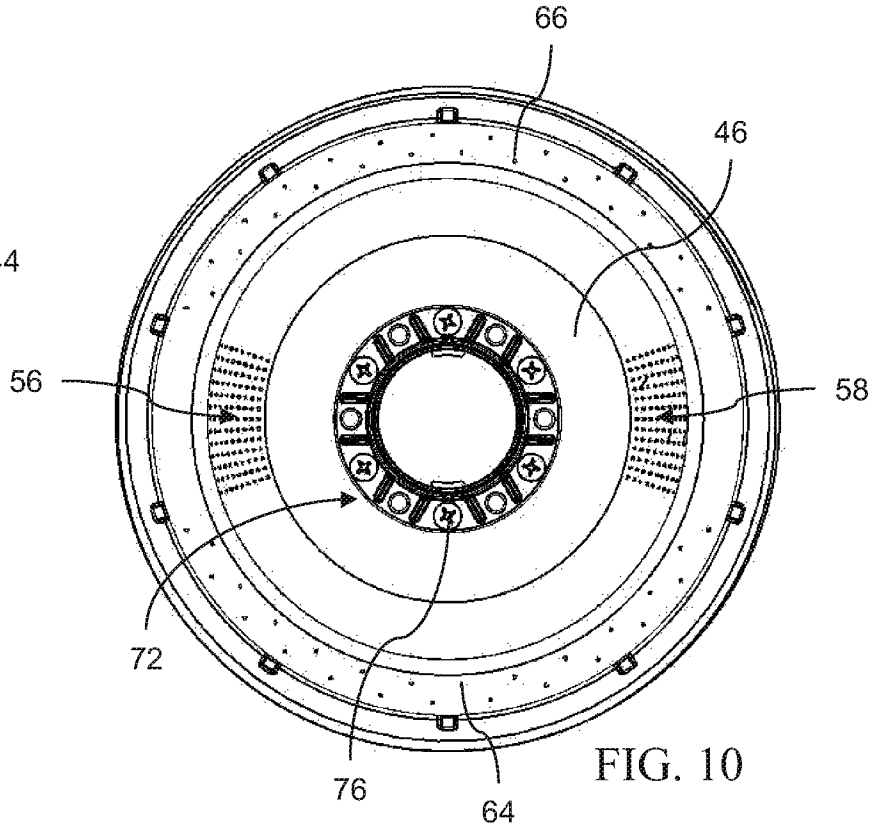
FIG. 10 is a bottom view of subcomponents of the upper irrigation assembly.

An annular plinth 40 is positioned on a top surface of the central planar circular portion 46. The plinth 40 has a central aperture 41 corresponding in dimension to the central aperture 48 of the lower base plate 44, the connecting core 72, and the central aperture 69 of the washer seal 68. Similar to the washer seal 68 and the connecting core 72, the plinth 40 has a plurality of threaded apertures 42 evenly distributed about the plinth 40. The plinth 40 is positioned such that the upper portion of the main cylindrical section 73 is inserted through the central aperture 41 of the plinth 40. As a result, the lower base plate 44 is positioned between the connecting core 72 and the plinth 40. When properly positioned, all four sets of threaded apertures 50, 75, 70, 42 are aligned with each other, and the plurality of threaded screws 76 are inserted into the aligned first subsets of threaded apertures to fasten the lower base plate 44, the connecting core 72, the washer seal 68, and the plinth 40 to each other. The fastened together lower base plate 44, connecting core 72, washer seal 68, and plinth 40 is referred to as the assembled lower base plate 44. FIG. 10 shows a bottom view of the assembled lower base plate 44.

With continued reference to FIGS. 9 and 10, the lower base plate 44 has an annular upwardly curved sidewall 52 extending outwardly from the central planar circular portion 46. A planar annular peripheral flange 60 extends outwardly from the terminating end of the upwardly curved sidewall 52. The structure and shape of the central planar circular portion 46, the upwardly curved sidewall 52, and the planar annular flange 60 provides the lower base plate 44 with a structure similar to that of a shallow bowl with a flared rim.

The plurality of spray outlets 54 are arranged on the upwardly curved sidewall 52. The spray outlets 54 are subdivided into two clustered subsets, namely a first subset of spray outlets 56 and a second subset of spray outlets 58. In certain embodiments, the two subsets 56, 58 are positioned such that centers of the two clusters are diametrically opposed from each other, with each cluster deployed near a respective shoulder region of the wetsuit to provide spray coverage to the respective shoulder region. Each of the subsets 56, 58 may have anywhere between tens and hundreds of spray outlets arranged in vertically stacked rows (of approximately 10 spray outlets per row) along the upwardly curved sidewall 52. Since the curvature of the upwardly curved sidewall 52 changes in the vertical direction, each row of spray outlets is positioned along a portion of the upwardly curved sidewall 52 having a different amount of curvature. The change in curvature results in different spray angles, relative to the main plane of the central planar circular portion 46, for each row of spray outlets of each of the subsets 56, 58. The angular spray variation provided by the spray outlets 54 enables wider spray coverage of exterior regions of the wetsuit, in particular the exterior shoulder regions of the wetsuit.

The plurality of spray outlets 62 are arranged on the planar annular flange 60. The spray outlets 62 are subdivided into two subsets, namely a first subset of spray outlets 64 and a second subset of spray outlets 66. In certain embodiments, the plurality of spray outlets 62 has fewer spray outlets than the plurality of spray outlets 54, however, in other embodiments, the pluralities of the spray outlets 54, 62 may have the same number of spray outlets, or the plurality of spray outlets 54 may have fewer spray outlets than the plurality of spray outlets 62.

Each of the subsets 64, 66 has spray outlets arranged in one or more rows along the planar annular flange 60. In certain embodiments, the two subsets 64, 66 are mirror images of each other, with one of the subsets deployed near the front region of the wetsuit and the other of the subsets deployed near the rear region of the wetsuit, thereby enabling spray coverage of the upper front and rear exterior portions of the wetsuit. Since the planar annular flange 60 is a substantially flat element, the curvature along the planar annular flange 60 remains relatively constant. Moreover, the main plane of the planar annular flange 60 is parallel to the main plane of the central planar circular portion 46. As a result, the two subsets 64, 66 provide directional spray of the liquid in a downward direction normal to the main plane of the central planar circular portion 46 (i.e., 90 degrees straight downward).

As is shown in FIGS. 9 and 10, the centers of the distributed subsets 64, 66 are offset by a quarter rotation (i.e., 90 degrees) from the centers of the distributed subsets 56, 58.

It is noted that the liquid provided by the spray outlets 54 and 62 to the exterior shoulder regions and front and rear exterior portions of the wetsuit also flows, for example under gravitational flow, to the lower and extremity portions/regions of the wetsuit. For example, the liquid provided by the spray outlets 54, while directed to impinge on the exterior shoulder regions, also flows to the exterior upper and lower arm and sleeve portions of the wetsuit, as well as the exterior upper chest, upper back, mid and lower torso, and leg regions of the wetsuit. Similarly, for example, the liquid provided by the spray outlets 62, while directed to impinge on the exterior upper front and rear portions of the wetsuit, also flow down to the exterior mid and lower torso, and leg regions of the wetsuit. Therefore, as a result of the arrangement of the spray outlets 54 and 62, the upper irrigation assembly 20 is able to efficiently irrigate the entire exterior of the wetsuit.

Figure 11:
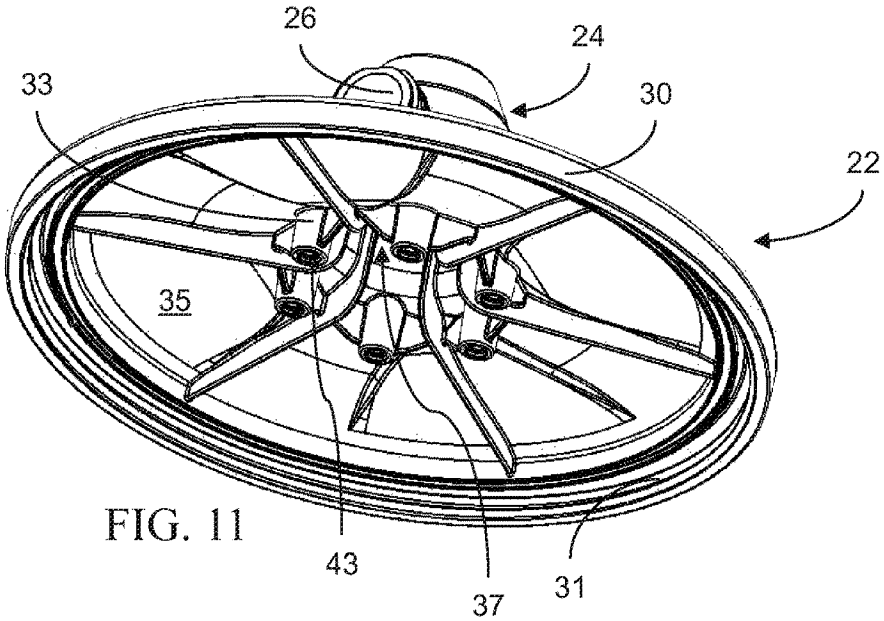
FIG. 11 is an isometric view of a cover assembly of the upper irrigation assembly, taken from below the cover assembly.

With continued reference to the FIGS. 1-10, refer now to FIG. 11, an isometric view of the cover assembly 22 taken from below the cover assembly 22. A plurality of posts extend downward from a bottom surface 35 of the cover assembly 22 and are evenly distributed around the circular perimeter of the internal opening 37 of the vertical flute portion 24. All of the posts 33 have a threaded opening 43 at a terminal end thereof. The openings 43 are dimensioned to receive a plurality of threaded screws When the cover assembly 22 as attached to the assembled lower base plate 44, the threaded apertures 33 are aligned with the second subsets of the four sets of threaded apertures 50, 75, 70, 42. The bottom surface 35 of the cover assembly 22 is bounded by a grooved region oppositely disposed from the downward flange 30. The grooved region has one or more peripheral grooves 31 extending around the interior surface of the downward flange 30. The peripheral groove 31 is dimensioned to receive correspondingly configured ridges.

Refer now to FIGS. 12A and 129, an exploded view and an enlarged view, respectively, of subcomponents of the upper irrigation assembly 20, illustrating the attachment configuration of the cover assembly 22 and the assembled lower base plate 44. Also refer to FIG. 13, a perspective view of the upper irrigation assembly 20, similar to FIG. 5, cut-away along a central plane of the upper irrigation assembly 20.

An O-ring 38 is positioned between a bottom interior portion of the cover assembly 22 and a peripheral edge of the planar annular peripheral flange 60. A bottom outer ring 80 provides a sealing engagement between the assembled lower base plate 44 and the cover assembly 22. The bottom outer ring 80 has an interior sidewall 85 having a flange 83 that projects inwardly therefrom. One or more peripheral ridges 81 extend around the exterior perimeter of the bottom outer ring 80. The peripheral ridge 81 and the peripheral groove 31 are correspondingly dimensioned (i.e., correspondingly configured), such that the peripheral ridge 81 fits in the peripheral groove 31. The bottom surface of the planar annular peripheral flange 60 rests on the top surface of the inwardly projecting flange 83.

The assembled lower base plate 44 is attached to the cover assembly 22 by aligning the second subsets of the threaded apertures 42 of the plinth 40 with the threaded apertures 33 of the cover assembly 22, and inserting a plurality of threaded screws 78 into the aligned threaded apertures. When the assembled lower base plate 44 is attached to the cover assembly 22, an internal chamber is formed by the bottom surface 35 of the cover assembly 22 and the top surface of the lower base plate 44 (i.e., the top surfaces of the central planar portion 46, the planar annular peripheral flange 60, and the upwardly curved sidewall 52). The internal chamber acts a fluid volume chamber into which the liquid from the liquid source flows into the upper irrigation assembly 20 via the main intake port 26. The O-ring 38 and the bottom outer ring 80 together act as a liquid seal which prevents unwanted escape of liquid from the fluid volume chamber, and forces the liquid in the chamber to escape solely through the spray outlets 54, 62.

Refer now to FIGS. 14-17, various views of the lower irrigation assembly 90. In general, the lower irrigation assembly 90 is constructed from various conduits, including, but not limited to, piping arrangements, pipes, and pipe segments, which facilitate fluid flow.

The lower irrigation assembly 90 has two piping arrangements, namely a first piping arrangement 92 (referred to interchangeably as "lower piping arrangement 92") and a second piping arrangement 140 (referred to interchangeably as "upper piping arrangement 140"). In certain embodiments, such as the exemplary embodiment shown in the drawings, the piping arrangements 92, 140 are separate members that are connected via two three-way flow connectors. In other embodiments, the piping arrangements 92, 140 and the three-way flow connectors are formed from a single member.

The lower piping arrangement 92 is formed from two curved pipes, namely a first curved pipe 94 and a second curved pipe 108. The curved pipes 94, 108 together form a generally elliptical shape having a major diameter approximately equal to the shoulder width of the main body 220 (and wetsuit), and having a minor diameter approximately equal to the chest to back depth of the main body 220 (and wetsuit). The first curved pipe 94 has a major external surface 95 and two pipe ends (i.e., a first end 96 and a second end 98). A first plurality of spray outlets 100 are arranged on the upper (i.e., top) portion of the major external surface 95 to provide directional spray of the liquid in an upward direction normal to the main plane of the ellipse 90 degrees straight upward), formed by the lower piping arrangement 92. The spray outlets 100 are subdivided into two subsets, namely a first subset of spray outlets 102 and a second subset of spray outlets 104. The first subset of spray outlets 102 are positioned closer to the first end 96, and the second subset of spray outlets 104 are positioned closer to the second end 98. A second plurality of spray outlets 106 are arranged on the lower (i.e., bottom) portion of the major external surface 95 to provide directional spray of the liquid in a downward direction normal to the main plane of the ellipse (i.e., 90 degrees straight downward), formed by the lower piping arrangement 92. In certain embodiments, the first plurality of spray outlets 100 has fewer spray outlets than the second plurality of spray outlets 106. In such embodiments, the second plurality of spray outlets 106 are evenly distributed between the two ends 96, 98.

The second curved pipe 108 is generally similar to the first curved pipe 94, and the two curved pipes 94, 108 are preferably diametrically opposed. The second curved pipe 108 has a major external surface 110 and two pipe ends (i.e., a first end 112 and a second end 114). A first plurality of spray outlets 116 are arranged on the upper (i.e., top) portion of the major external surface 110 to provide directional spray of the liquid in an upward direction normal to the main plane of the ellipse (i.e., 90 degrees straight upward), formed by the lower piping arrangement 92. The spray outlets 116 are subdivided into two subsets, namely a first subset of spray outlets 118 and a second subset of spray outlets 120. The first subset of spray outlets 118 are positioned closer to the first end 112, and the second subset of spray outlets 120 are positioned closer to the second end 114. A second plurality of spray outlets 122 are arranged on the lower (i.e., bottom) portion of the major external surface 110 to provide directional spray of the liquid in a downward direction normal to the main plane of the ellipse (i.e., 90 degrees straight downward), formed by the lower piping arrangement 92. In certain embodiments, the first plurality of spray outlets 116 has fewer spray outlets than the second plurality of spray outlets 122. In such embodiments, the second plurality of spray outlets 122 are evenly distributed between the two ends 112, 114.

The two curved pipes 94, 108 are connected to each other via two bent Y-shaped three-way flow connectors (i.e., a first flow connector 124 and a second flow connector 132). Each of the flow connectors 124, 132 acts as flow junctions which provide a fluid flow connection between the two curved pipes 94, 108. The first flow connector 124 has a vertically oriented intake port 126 and two horizontally oriented outlet ports (i.e., a first outlet port 128 and a second outlet port 130). Similarly, the second flow connector 132 has a vertically oriented intake port 134 and two horizontally oriented outlet ports (i.e., a first outlet port 136 and a second outlet port 138).

The first outlet port 128 is connected to the first end 96 of the first curved pipe 94, and the second outlet port 130 is connected to the first end 112 of the second curved pipe 108. The first outlet port 136 is connected to the second end 98 of the first curved pipe 94, and the second outlet port 138 is connected to the second end 114 of the second curved pipe 108.

According to certain embodiments, each of the flow connectors 124, 132 has one or more spray outlets 131, 139 arranged on a bottom surface of the flow connectors 124, 132, and in the same plane as the spray outlets 106, 122. As such, the spray outlets 131, 139 provide directional spray of the liquid in a downward direction normal to the main plane of the ellipse (i.e., 90 degrees straight downward), formed by the lower piping arrangement 92.

The first flow connector 124 has a pair of threaded apertures 127, and similarly the second flow connector 132 has a pair of threaded apertures 135. The threaded apertures 127, 135 are configured to receive threaded screws in order to fixedly attach the main body 220 to the lower irrigation assembly 90, as will be described in further detail in subsequent sections of the present disclosure.

The upper piping arrangement 140 has at least one pipe segment that is connected to an intake flow connector. In certain embodiments, such as the exemplary embodiment illustrated in the drawings, the intake flow connector is implemented as a Y-shaped three-way flow connector 182 that connects together a first pipe segment 142 and a second pipe segment 150 via a first outlet port 188 and a second outlet port 190. The flow connector 182 has a vertically oriented intake pipe 184 having an intake port 186, which functions as the intake port for the lower irrigation assembly 90. As will be described in subsequent sections of the present disclosure, the intake port 186 provides a fluid flow connection between the two irrigation assemblies 20, 90, and receives liquid from the main intake port 26 via the upper irrigation assembly 20.

The upper piping arrangement 140 is connected to the lower piping arrangement 92 such that each of the pipe segments 142, 150 passes above the lower piping arrangement 92, and such that the upper piping arrangement 140 extends transversally across the lower piping arrangement 92. The projection of the upper piping arrangement 140 in the main plain of the ellipse, formed by the lower piping arrangement 92, extends along the major diameter of the ellipse, and therefore bisects the lower piping arrangement 92.

A first curved L-shaped two-way flow connector 170, having an intake port 172 and an outlet port 174, connects together the first pipe segment 140 and the first three-way flow connector 124. A second curved L-shaped two-way flow connector 176, having an intake port 178 and an outlet port 180, connects together the second pipe segment 150 and the second three-way flow connector 132.

The first pipe segment 140 has a major external surface 144 and two pipe ends (i.e., a first end 146 and a second end 148). The first end 146 of the first pipe segment 140 is connected to the first outlet port 188, and the second end 148 of the first pipe segment 140 is connected to the intake port 172. The outlet port 174 is connected to the intake port 126. The second pipe segment 150 has a major external surface 152 and two pipe ends (i.e., a first end 154 and a second end 156). The first end 154 of the second pipe segment 150 is connected to the second outlet port 190, and the second end 156 of the second pipe segment 150 is connected to the intake port 178. The outlet port 180 is connected to the intake port 134.

In certain embodiments, the two pipe segments 142, 150 are deployed at inclines, such that the first end 146 is positioned higher than the second end 148, and the first end 148 is positioned higher than the second end 156. In addition, the first ends 146, 154 are preferably positioned at the same height, and the second ends 148, 156 are preferably positioned at the same height.

Note that the above connections between pipe ends, pipe segment ends, intake ports, and outlet ports may be facilitated by mechanical piping linkage devices, including, but not limited to, adapters, washers, and O-rings. Also note that although the embodiments described above have pertained to the interconnections of various pipes and pipe segments via two-way and three-way flow connectors implemented as separate members, other embodiments are possible in which some or all of the separate members are implemented as single members.

A first plurality of spray outlets 158 and a second plurality of spray outlets 164 are arranged on upper side portions of the major external surfaces 144, 152 to provide directional spray of the liquid in an upward direction. The spray outlets 158 are subdivided into two subsets, namely a first subset of spray outlets 160 and a second subset of spray outlets 162. The first subset of spray outlets 160 are arranged on the first pipe segment 142, near the second end 148 (i.e., near the first flow connector 124), along an upper side portion of the major external surface 144 that is closer in proximity to the first curved pipe 94 than to the second curved pipe 108. The spray outlets 160 are arranged in a row that extends parallel to the longitudinal axis of the first pipe segment 142. Since the first pipe segment 142 is positioned at an incline, the individual spray outlet of the first subset of spray outlets 160 closest to the second end 148 is positioned at a lower height than the individual spray outlet of the first subset of spray outlets 160 furthest from the second end 148. In certain embodiments, the individual spray outlets of the first subset of spray outlets 160 are arranged to provide directional spray at a common oblique angle relative to the vertical plane defined by the longitudinal axes of the first pipe segment 142 and the intake pipe 184. The angle is measured positively in the direction from the vertical plane to the first curved pipe 94. In other embodiments, the individual spray outlets of the first subset of spray outlets 160 are arranged to provide directional spray at different oblique angles relative to the vertical plane defined by the longitudinal axes of the first pipe segment 142 and the intake pipe 184.

The second subset of spray outlets 162 are arranged on the second pipe segment 150, near the second end 156 (i.e., near the second flow connector 132), along an upper side portion of the major external surface 152 that is closer in proximity to the first curved pipe 94 than to the second curved pipe 108. The spray outlets 162 are arranged in a row that extends parallel to the longitudinal axis of the second pipe segment 150. Since the second pipe segment 150 is positioned at an incline, the individual spray outlet of the second subset of spray outlets 162 closest to the second end 156 is positioned at a lower height than the individual spray outlet of the second subset of spray outlets 162 furthest from the second end 156. In certain embodiments, the individual spray outlets of the second subset of spray outlets 162 are arranged to provide directional spray at a common oblique angle relative to the vertical plane defined by the longitudinal axes of the second pipe segment 150 and the intake pipe 184. The angle is measured positively in the direction from the vertical plane to the first curved pipe 94. In other embodiments, the individual spray outlets of the second subset of spray outlets 162 are arranged to provide directional spray at different oblique angles relative to the vertical plane defined by the longitudinal axes of the second pipe segment 150 and the intake pipe 184.

According to certain embodiments, the individual spray outlets of the first and second subsets of spray outlets 160, 162 are arranged to provide directional spray at a common oblique angle relative to the vertical plane defined by the longitudinal axes of the second pipe segment 150 and the intake pipe 184.

The second plurality of spray outlets 164 are subdivided into two subsets, namely a first subset of spray outlets 166 and a second subset of spray outlets 168. The first subset of spray outlets 166 are arranged on the first pipe segment 142, near the second end 148 (i.e., near the first flow connector 124), along an upper side portion of the major external surface 144 that is closer in proximity to the second curved pipe 108 than to the first curved pipe 94. The spray outlets 166 are arranged in a row that extends parallel to the longitudinal axis of the first pipe segment 142. Since the first pipe segment 142 is positioned at an incline, the individual spray outlet of the first subset of spray outlets 166 closest to the second end 148 is positioned at a lower height than the individual spray outlet of the first subset of spray outlets 160 furthest from the second end 148. In certain embodiments, the individual spray outlets of the first subset of spray outlets 166 are arranged to provide directional spray at a common oblique angle relative to the vertical plane defined by the longitudinal axes of the first pipe segment 142 and the intake pipe 184. The angle is measured positively in the direction from the vertical plane to the second curved pipe 108. In other embodiments, the individual spray outlets of the first subset of spray outlets 166 are arranged to provide directional spray at different oblique angles relative to the vertical plane defined by the longitudinal axes of the first pipe segment 142 and the intake pipe 184.

The second subset of spray outlets 168 are arranged on the second pipe segment 150, near the second end 156 (i.e., near the second flow connector 132), along an upper side portion of the major external surface 152 that is closer in proximity to the second curved pipe 108 than to the first curved pipe 94. The spray outlets 168 are arranged in a row that extends parallel to the longitudinal axis of the second pipe segment 150. Since the second pipe segment 150 is positioned at an incline, the individual spray outlet of the second subset of spray outlets 168 closest to the second end 156 is positioned at a lower height than the individual spray outlet of the second subset of spray outlets 168 furthest from the second end 156. In certain embodiments, the individual spray outlets of the second subset of spray outlets 168 are arranged to provide directional spray at a common oblique angle relative to the vertical plane defined by the longitudinal axes of the second pipe segment 150 and the intake pipe 184. The angle is measured positively in the direction from the vertical plane to the second curved pipe 108. In other embodiments, the individual spray outlets of the second subset of spray outlets 168 are arranged to provide directional spray at different oblique angles relative to the vertical plane defined by the longitudinal axes of the second pipe segment 150 and the intake pipe 184.

According to certain embodiments, the individual spray outlets of the first and second subsets of spray outlets 166, 168 are arranged to provide directional spray at a common oblique angle relative to the vertical plane defined by the longitudinal axes of the second pipe segment 150 and the intake pipe 184.

Figure 18:
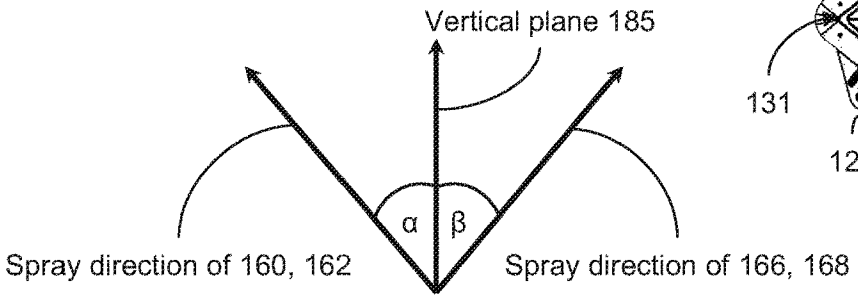
FIG. 18 a vector representation of the directional spray of spray outlets of an upper piping arrangement of the lower irrigation assembly.
Figure 19:
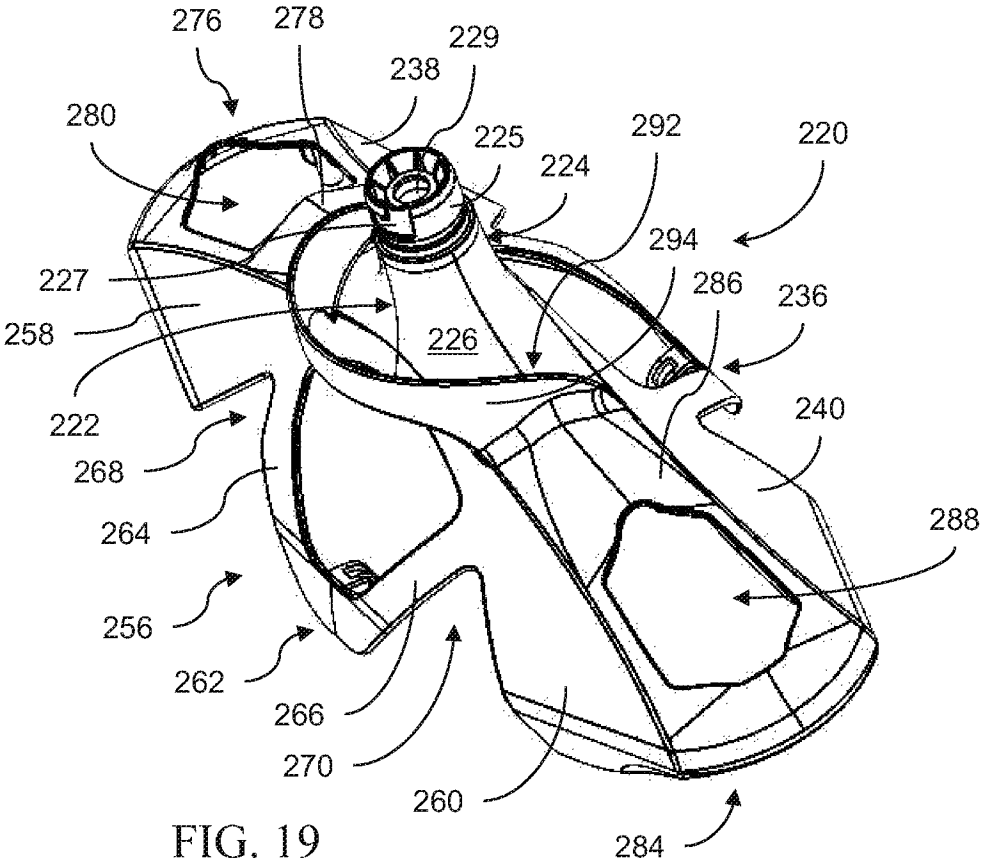
FIG. 19 is an isometric view of the main body of the device of FIG. 1, taken from above the main body.
Figure 20:
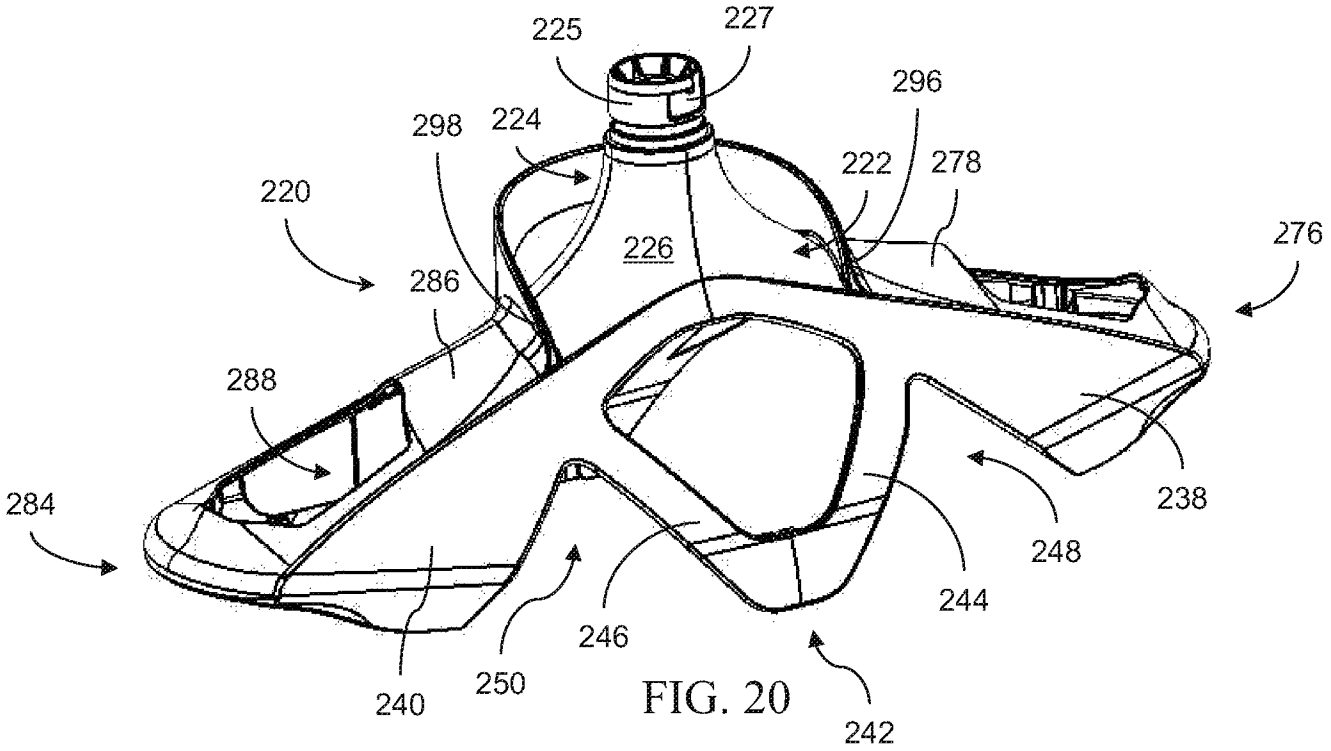
FIG. 20 is an isometric view of the main body of FIG. 19, taken from in front of the main body.

FIG. 18 shows a vector representation of the directional spray of the pluralities of spray outlets 158, 164, in which the first and second subsets of spray outlets 160, 162 are arranged to provide directional spray at a common oblique angle $\alpha$ relative to the vertical plane 185 defined by the longitudinal axes of the pipe segments 142, 150 and the intake pipe 184, and in which the first and second subsets of spray outlets 166, 168 are arranged to provide directional spray at a common oblique angle $\beta$ relative to the vertical plane defined by the longitudinal axes of the pipe segments 142, 150 and the intake pipe 184.

In certain embodiments, the pluralities of spray outlets 158, 164 are symmetrically positioned on the major external surfaces of the pipe segments 142, 150 such that all of the spray outlets of the pluralities of spray outlets 158, 164 are arranged to provide directional spray at a common oblique angle relative to the vertical plane defined by the longitudinal axes of the pipe segments 142, 150 and the intake pipe 184. The symmetric positioning results in the oblique angles $\alpha$ and $\beta$ being equal. In principle, the oblique angles can be anywhere between 0° and 90° (non-inclusive), but in practice, the oblique angles are closer to 45°, and are preferably in a range between 30° and 60°.

By deploying the subsets of spray outlets of the pluralities of spray outlets 158, 164 at oblique angles, near the flow connectors 124, 132, the upper piping arrangement 140 is able to provide spray of the liquid to the interior upper front and back portions of the wetsuit, and in particular, to the interior front and back portions shoulder regions of the wetsuit. Specifically, the subsets of spray outlets 160, 162 are arranged to provide spray of the liquid to the interior back shoulder region of different respective shoulders of the wetsuit. Similarly, the subsets of spray outlets 166, 168 are arranged to provide spray of the liquid to the interior front shoulder region of different respective shoulders of the wetsuit.

It is noted that the liquid provided by the spray outlets of the lower irrigation assembly 90 to the interior upper back, upper chest, and shoulder regions of the wetsuit also flows, for example under gravitational flow, to the interior lower and extremity portions/regions of the wetsuit. For example, the liquid provided by the spray outlets 100, 106, 116, 122, 158, 164, while directed to impinge on specific interior regions of the wetsuit, also flows to interior upper and lower arm and sleeve portions of the wetsuit, as well as the interior upper chest, upper back, mid and lower torso, and leg regions of the wetsuit. Therefore, as a result of the arrangement of the spray outlets 100, 106, 116, 122, 158, 164, the lower irrigation assembly 90 is able to efficiently irrigate the entire interior of the wetsuit.

As mentioned above, the main body 220 is attached to the lower irrigation assembly 90 and is removably attachable to the upper irrigation assembly 20, thereby providing removable attachment of the two irrigation assemblies 20 and 90. When in use, a wetsuit is typically mounted to the device 10 by opening the main zipper of the wetsuit, placing the wetsuit on the main body 220, and then closing the main zipper. The following paragraphs describe the structure of the main body 220, the attachment of the main body 220 to the lower irrigation assembly 90, and the fluid flow connection between the irrigation assemblies 20 and 90 facilitated by the main body 220.

Refer now to FIGS. 19-22, various views of the main body 220 for mounting a wetsuit thereon. The main body 220 is generally shaped and constructed to mimic the form of the upper interior portions of the wetsuit and the upper body portions of the human body. The construction allows the main body 220 to maintain the structural integrity and shape of the wetsuit when the wetsuit is mounted to the main body 220. Specifically, the main body 220 has a plurality of major external surfaces 226, 278, 286 that together conform in size and shape to the upper chest, shoulder, upper back, and lower neck portions of an average human body. The main body may be constructed from any rigid waterproof, and preferably light weight material, such as, for example, PVC or plastic.

The main body 220 has an upper portion 222 having an external surface 226 from which a hollow vertical flute portion 224 extends. The flute portion 224 has an outer sidewall 225 with a locking groove 227 positioned near the terminating end of the flute portion 224. The flute portion 224 further includes a central opening 229, for receiving the intake pipe 184, on an internal surface 228 of the upper portion 222.

Two shoulder portions, namely a first (i.e., left) shoulder portion 276 and a second (i.e., right) shoulder portion 284, extend outwardly, away from each other, from the upper portion 222. The shoulder portions 276, 284 have rounded and tapered ends, generally mimicking the form and structure of the human shoulder. The two shoulder portions 276, 284 are hounded by a curved front plate 236 and a curved back plate 256. The front plate 236 and back plate 256 generally mimic the form and structure of the upper interior chest and back portions of the wetsuit and the human chest and upper back, respectively. The first shoulder portion 276 is constructed to support the interior right shoulder portion of the wetsuit, and the second shoulder portion 284 is constructed to support the interior left shoulder portion of the wetsuit.

The front plate 236 has two outwardly extending curved wings, namely a first wing 238 and a second wing 240. The first wing 238 extends outwardly from the upper portion 222 toward the tapered end of the first shoulder portion 276, and the second wing 240 extends outwardly from the upper portion 222 toward the tapered end of the second shoulder portion 284. The front plate 236 also has a curved central portion 242 that extends downward from the upper portion 222. The curved central portion 242 is formed by two converging curved branches, namely a first branch 244 that extends downward from the first wing 238 and a second branch 246 that extends downward from the second wing 240. A first generally triangular opening 248 is formed by the first branch 244 and the first wing 238, and a second generally triangular opening 250 is formed by the second branch 246 and the second wing 240.

The back plate 256 has two outwardly extending curved wings, namely a first wing 258 and a second wing 260. The first wing 258 extends outwardly from the upper portion 222 toward the tapered end of the first shoulder portion 276, and the second wing 260 extends outwardly from the upper portion 222 toward the tapered end of the second shoulder portion 284. The back plate 256 also has a curved central portion 262 that extends downward from the upper portion 222. The curved central portion 262 is formed by two converging curved branches, namely a first branch 264 that extends downward from the first wing 258 and a second branch 266 that extends downward from the second wing 260. A first generally triangular opening 268 is formed by the first branch 264 and the first wing 258, and a second generally triangular opening 270 is formed by the second branch 266 and the second wing 260.

The first shoulder portion 276 has an external surface 278 that extends between, and is bounded by, the first wings 238, 258. The external surface 278 has a slot opening 280 for allowing the liquid expelled by a first group of the spray outlets to pass therethrough. Similarly, the second shoulder portion 284 has an external surface 286 that extends between, and is bounded by, the second wings 240, 260. The external surface 286 has a slot opening 288 for allowing the liquid expelled by a second group of the spray outlets to pass therethrough.

The front plate 236 and the back plate 256, as well as the curved central portions 242, 262, are dimensioned to space apart the chest and back portions of the wetsuit when the wetsuit is mounted to the main body 220, to allow liquid to circulate through the interior portions of the wet suit.

A flared neck portion 292 having a vertical sidewall 294 curves around the upper portion 222 between tow terminal ends, namely a first end 296 and a second end 298. The first end 296 of the flared neck portion 292 is located between the front plate 236 and the hack plate 256 along a portion of the main body 220 where the upper portion 222 and the first shoulder portion 276 converge. The second end 298 of the flared neck portion 292 is located between the front plate 236 and the back plate 256 along a portion of the main body 220 where the upper portion 222 and the second shoulder portion 284 converge. The flared neck portion 292 extends upward and outward from the back plate 256, and may be used as a grip for lifting the main body 220.

Figure 21:
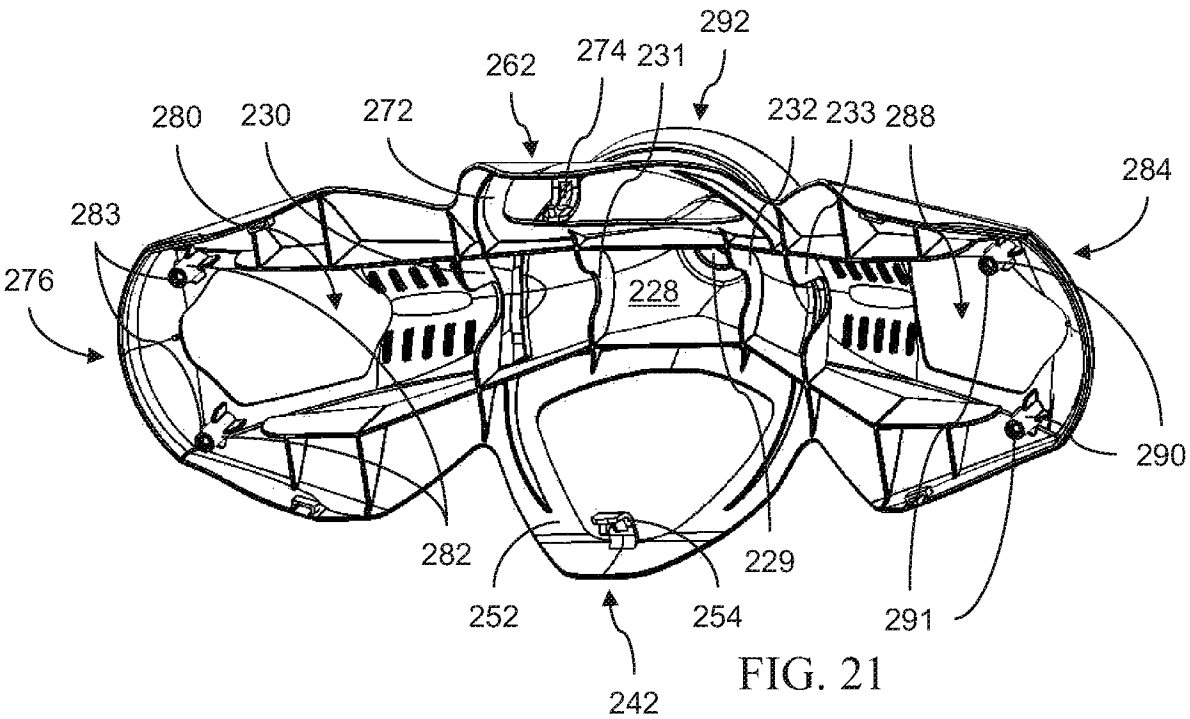
FIG. 21 is an isometric view of the main body of FIG. 19, taken from below the main body.
Figure 22:
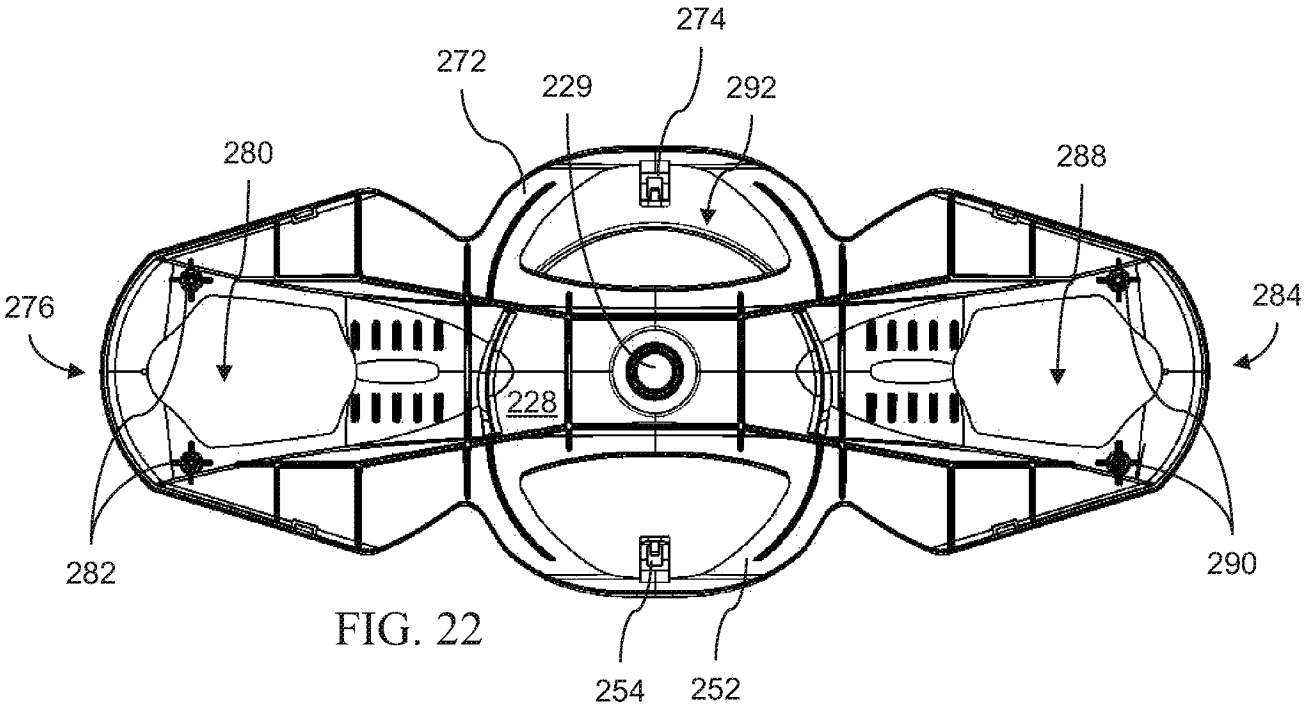
FIG. 22 is a bottom view of the main body of FIG. 19.

FIGS. 21 and 22 show the underside of the main body 22. As is shown in FIGS. 21 and 22, each of the shoulder portions 276, 284 has a respective pair of downwardly projecting posts 282, 290 with threaded openings 283, 291 configured to receive threaded screws in order to fixedly attach the main body 220 to the lower irrigation assembly 90. Four curved ridges (i.e., a first curved ridge 230, a second curved ridge 231, a third curved ridge 232, and a fourth curved ridge 233) project downward from the internal surface 228 of the upper portion 222. The curved central portion 242 has an internal surface 252 having a hook-shaped mechanism 254 for receiving one of the curved pipes of the lower piping arrangement 92. Similarly, the curved central portion 262 has an internal surface 272 having a hook-shaped mechanism 274 for receiving the other of the curved pipes of the lower piping arrangement 92.

Figure 24:
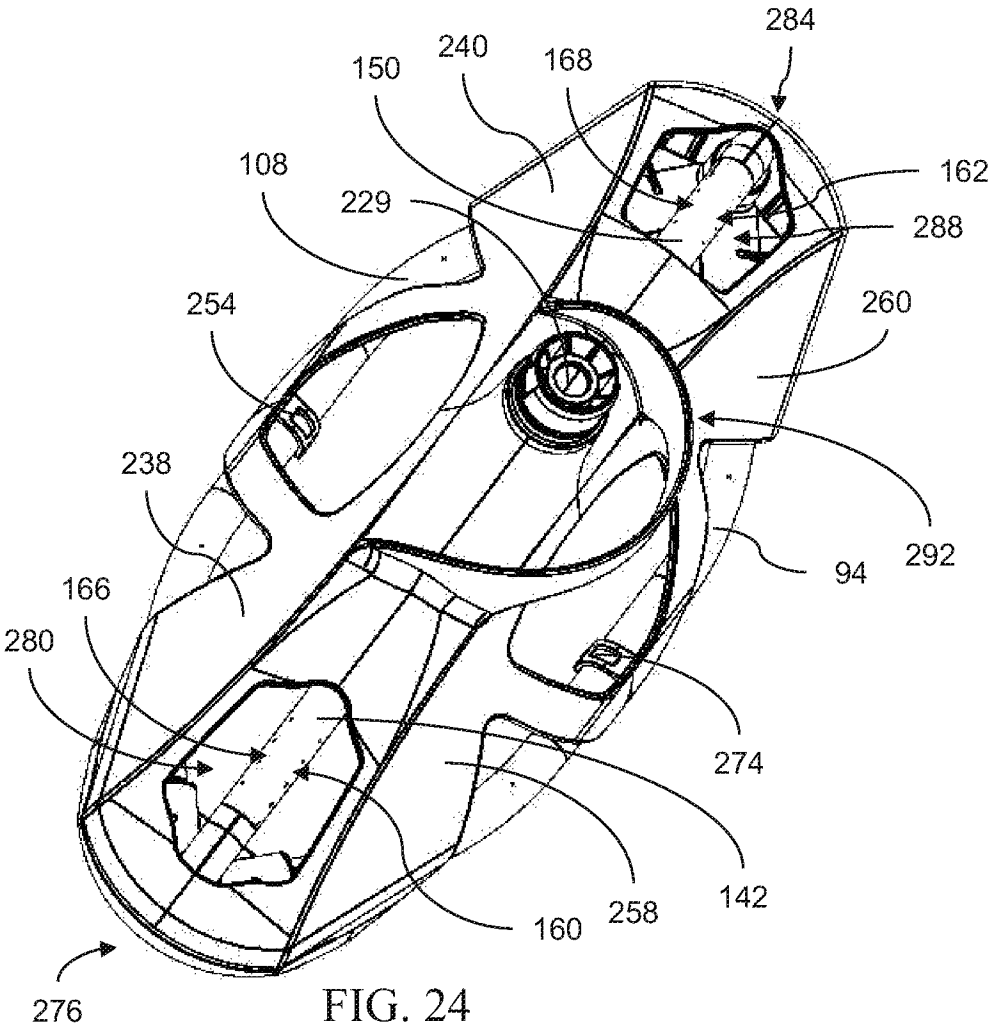
FIG. 24 is an isometric view of the main body attached to the lower irrigation assembly.
Figure 23:
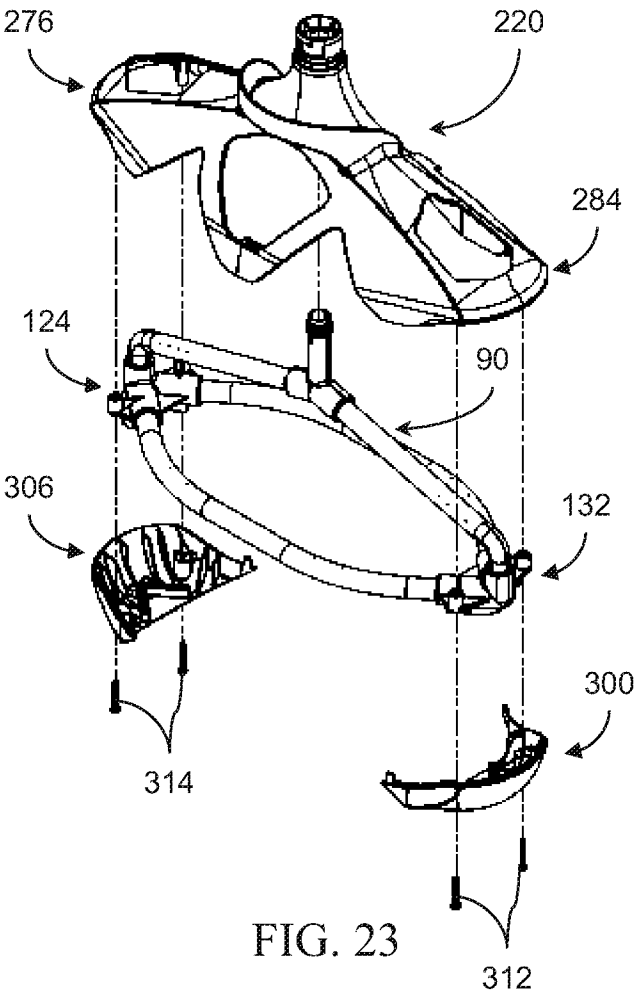
FIG. 23 is an isometric exploded view of the attachment of the main body to the lower irrigation assembly.
Figure 25:
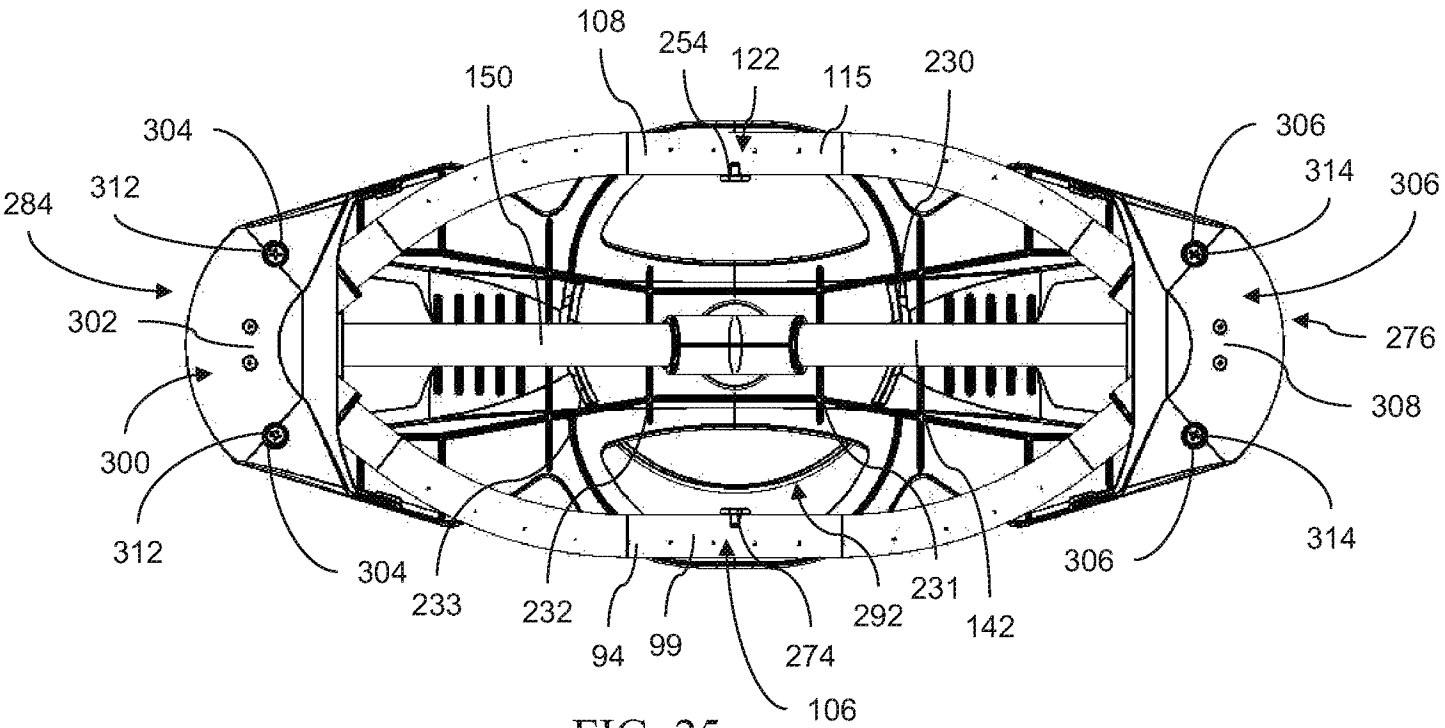
FIG. 25 is a bottom view of the main body and the lower irrigation assembly of FIG. 24.
Figure 26:
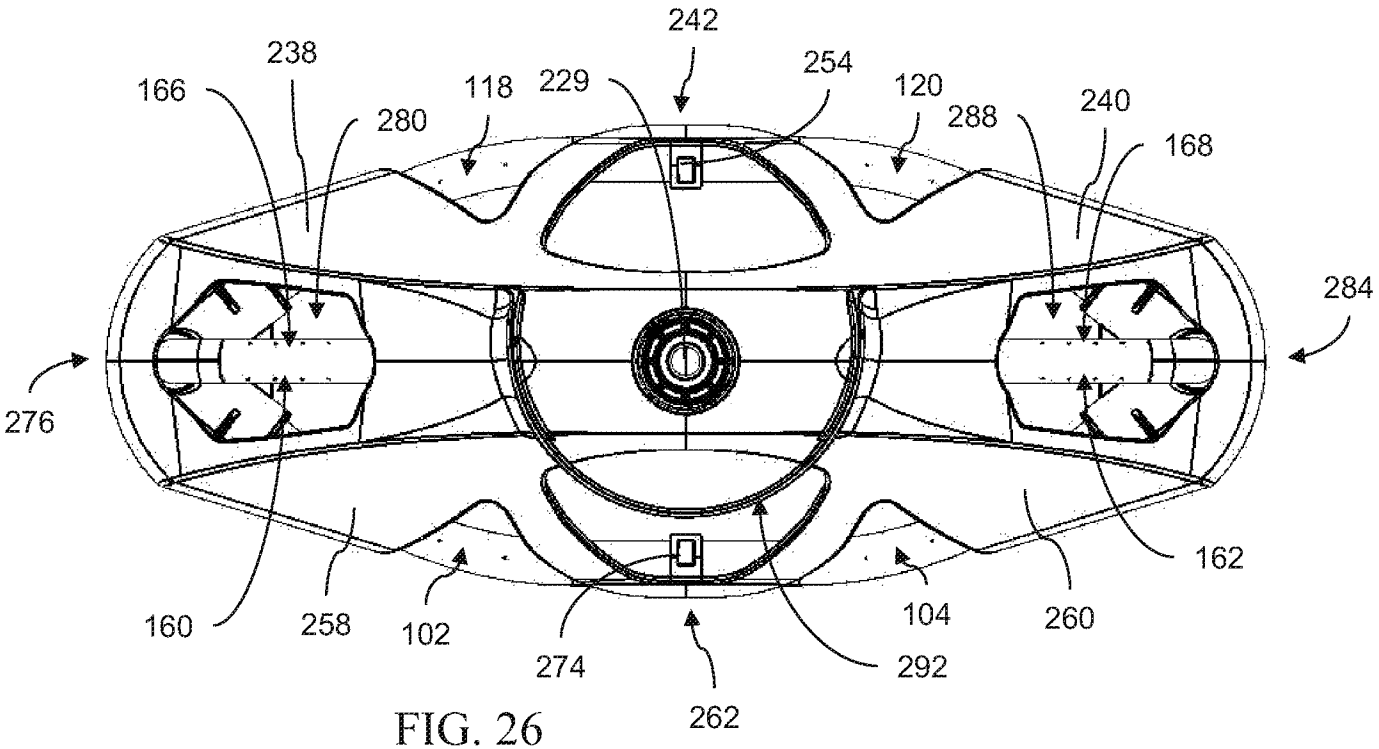
FIG. 26 is a top view of the main body and the lower irrigation assembly of FIG. 24.
Figure 27:
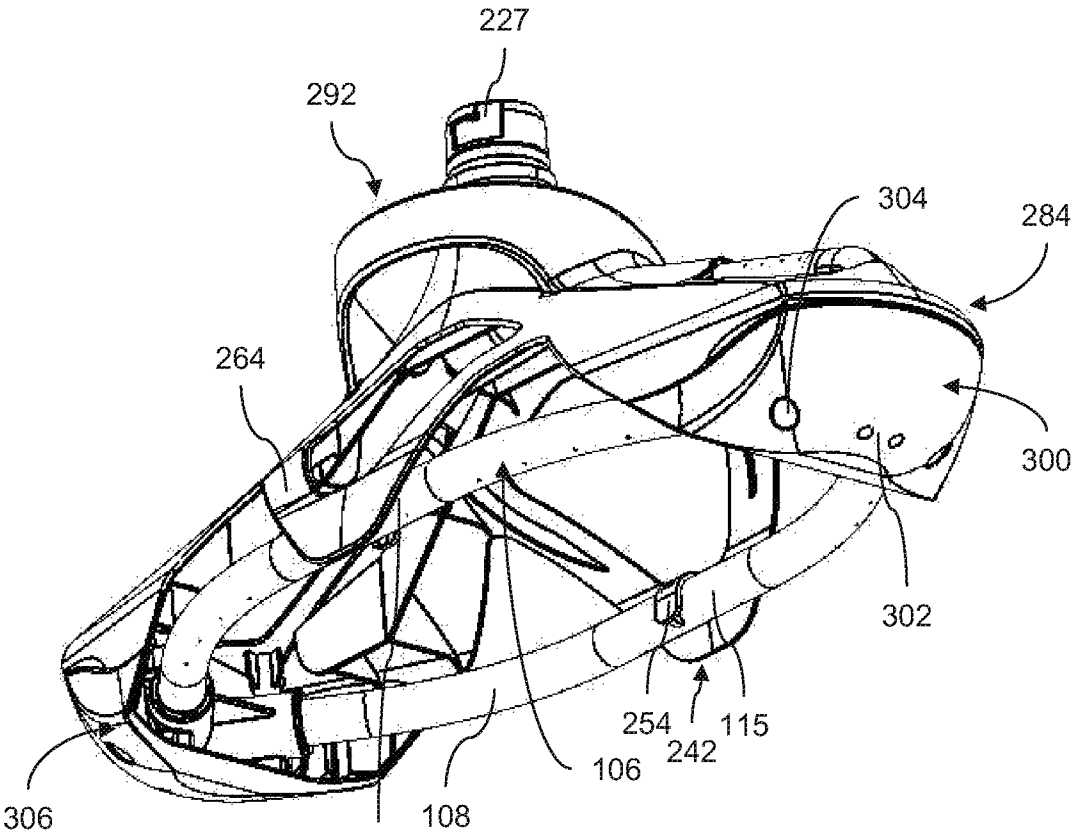
FIG. 27 is an isometric view of the main body and the lower irrigation assembly of FIG. 24, taken from below the lower irrigation assembly.

With continued reference to FIGS. 19-22, refer now to FIGS. 23-28, various views of the main body 220 attached to the lower irrigation assembly 90. As is shown in FIGS. 24 and 26, the main body 220 is attached to the lower irrigation assembly 90 such that the first shoulder portion 276 covers the first flow connector 124, the first end 96 of the first curved pipe 94, the first end 112 of the second curved pipe 108, the first pipe segment 142 of the upper piping arrangement 140, and the flow connector 170. Similarly, the second shoulder portion 284 covers the second flow connector 132, the second end 98 of the first curved pipe 94, the second end 114 of the second curved pipe 108, the second pipe segment 150 of the upper piping arrangement 140, and the flow connector 176.

The main body 220 is positioned such that the first subsets of spray outlets 160, 166 and portions of the flow connectors 124, 170 are uncovered by the slot opening 280, allowing the liquid expelled by the first subsets of spray outlets 160, 166 to pass through the slot opening 280 into the interior of the wetsuit. Similarly, the second subsets of spray outlets 162, 168 and portions of the flow connectors 132, 176 are uncovered by the slot opening 288, allowing the liquid expelled by the second subsets of spray outlets 162, 168 to pass through the slot opening 288 into the interior of the wetsuit.

As is shown in FIGS. 24 and 26, the main body 220 is positioned such a segment 99 of the first curved pipe 94 is inserted into an opening of the hook-shaped mechanism 274, and a segment 115 of the second curved pipe 108 is inserted into an opening of the hook-shaped mechanism 254. The segment 99 is a center non-curved (i.e., straight) portion of the first curved pipe 94. Similarly, the segment 115 is a center non-curved (i.e., straight) portion of the second curved pipe 108. When the wetsuit is mounted to the main body 220, the segments 99 and 115 are arranged to extend along upper interior rear and front portions, respectively, of the wetsuit.

The main body 220 is fastened to the lower irrigation assembly 90 via a pair of shoulder portion fasteners, namely a first fastener 300 and a second fastener 306, as is shown in FIGS. 24, 25, 27 and 28. The first fastener 300 has a pair of threaded apertures 304 and a pair of spray apertures 302. The first fastener 300 attaches to the bottom of the first shoulder portion 276 with the first flow connector 124 maintained between the first fastener 300 and the first shoulder portion 276. The threaded openings and apertures 127, 283, 310 are aligned with each other, and a pair of threaded screws 312 are inserted into the aligned apertures 127, 283, 310 to fasten the first fastener 300 to the first shoulder portion 276. When attached, the spray apertures 302 are aligned with spray outlets 131 of the first flow connector 124 to allow the liquid to escape into interior portions of the wetsuit via the spray outlets 131.

Similarly, the second fastener 306 has a pair of threaded apertures 306 and a pair of spray apertures 308. The second fastener 306 attaches to the bottom of the second shoulder portion 284 with the second flow connector 132 maintained between the second fastener 306 and the second shoulder portion 284. The threaded openings and apertures 135, 291, 304 are aligned with each other, and a pair of threaded screws 314 are inserted into the aligned apertures 135, 291, 304 to fasten the second fastener 306 to the second shoulder portion 284. When attached, the spray apertures 308 are aligned with spray outlets 139 of the second flow connector 132 to allow the liquid to escape into interior portions of the wetsuit via the spray outlets 139.

The fasteners 300, 306 are generally curved members which conform in shape to the interior outer shoulder portions of the wetsuit, thereby aiding in maintaining structural integrity and shape of the wetsuit when the wetsuit is mounted to the main body 220. In addition, the fasteners 300, 306 may be constructed from a flexible material, such as, for example, rubber, allowing the user of the device 10 to grip the fasteners 300, 306, and more easily manipulate the main body 220 to mount device 10 to a rack or rope in order to hang the wetsuit.

The main body 220 is attached to the lower irrigation assembly 90 such that the intake pipe 184 is inserted from the underside of the main body 220 through the central opening 229. The upper side of the first pipe segment 142 rests in the first curved ridge 230 and the second curved ridge 231. The upper side of the second pipe segment 150 rests in the third curved ridge 232 and the fourth curved ridge 233. An O-ring or washer may be positioned between the exterior of the intake pipe 184 and the interior of the central opening 229 to create a sealing engagement therebetween. The main body 220, and therefore the lower irrigation assembly 90, is attachable to the upper irrigation assembly 20 via engagement of the protruding portion 77 of the connecting core 72 and the locking groove 227 of the flute portion 224. To attach the main body 220 to the upper irrigation assembly 20, the flute portion 224 is inserted into the cylindrical section 73 of the connecting core 72 (as indicated by the arrow in FIG. 4) to align to the protruding portion 77 with an opening of the locking groove 227. The main body 220 is then rotated (i.e., counter clockwise rotation) to allow the protruding portion 77 to slide into the locking groove 227, thereby resulting in the locking engagement of the main body 220 and the upper irrigation assembly 20. Disengagement of the main body 220 from the upper irrigation assembly 20 is facilitated by reversibly rotating (i.e., clockwise rotation) the main body 220 to allow the protruding portion 77 to slide out of the locking groove 227.

The attachment and detachment made enabled by the cooperation of the connecting core 72 and the main body 220 allows the user of the device 10 to easily mount a wetsuit to the device 10. For example, a typical wetsuit mounting procedure may be performed by the user first detaching the main body 220 from the upper irrigation assembly 20. The user may then mount the upper irrigation assembly 20 to a rack or rope (via the hook assembly 200 as will be subsequently described). The user may then mount the wetsuit to the main body 220 by fitting the first and second shoulder portions 276, 284 into the interior left and right shoulder portions, respectively, of the wetsuit, with the flared neck portion 292 extending out from the neck portion of the wetsuit near the back of the wetsuit. The user may then attach the main body 220 to the upper irrigation assembly 20 via the attachment methodology described above.

Figure 29:
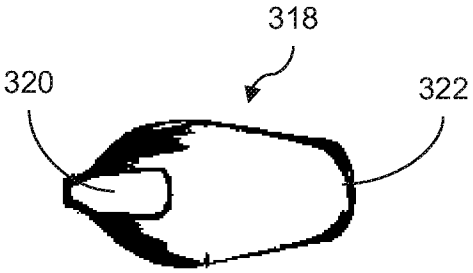
FIG. 29 is a top view of an add-on clip for attaching to the main body.
Figure 28:
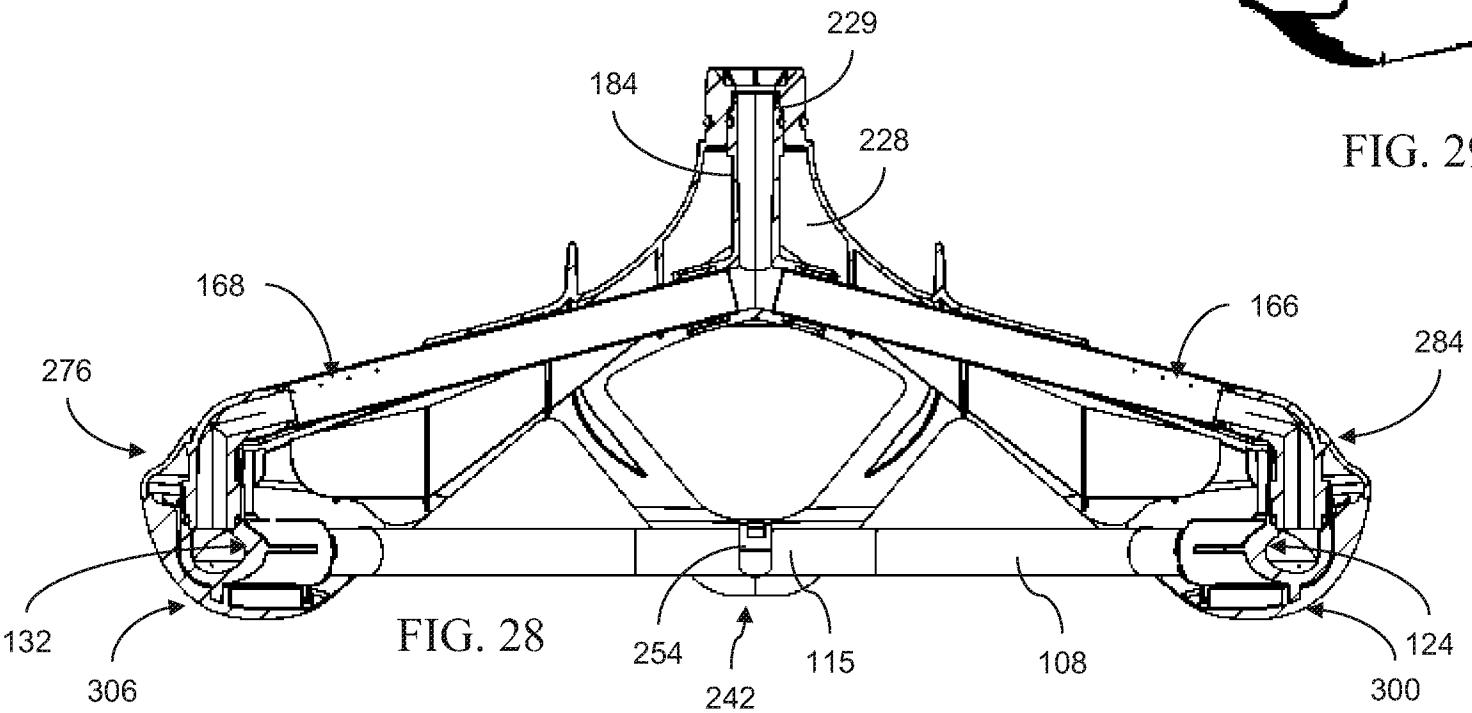
FIG. 28 is a perspective view of the main body and the lower irrigation assembly similar to FIG. 27, cut-away along a central plane of the main body and the lower irrigation assembly.

According to certain embodiments, an add-on clip 318 may be detachably connected to the each of the shoulder portions 276, 284. The add-on clip 318 is arranged to increase the shoulder width of the main body 220 (i.e., increase the distance between the tapered ends of the shoulder portions 276, 284 which is nominally in the range of 40-50 centimeters). The attachment of the add-on clip 318 allows a user of the device 10 to mount a larger sized wetsuit to the device 10 by increasing the shoulder width of the main body 220. FIG. 29 illustrates a top view of the add-on clip 318. A bottom section of the add-on clip 318 is inserted into the relevant slot opening 280, 288 and is attached via pressure engagement. The add-on clip 318 has a slot opening 320 that is similarly dimensioned to the slot openings 280, 288, thereby allowing expelled liquid from the spray outlets to pass through the slot opening 320. The add-on clip 318 has an end portion 322 that extends beyond the tapered end of the relevant shoulder portion 276, 284.

The following paragraphs describe the flow path of the liquid through the device 10. The liquid is introduced to the device 10 from, for example, a garden hose or other conduit, connected to the main intake port 26. The liquid then flows into the fluid chamber of the upper irrigation assembly 20 formed by the attached cover assembly 22 and the lower base plate 44. The liquid escapes through the spray outlets 54, 62 of the upper irrigation assembly 20 to cover the exterior portions of the wetsuit. The liquid from the fluid chamber also flow into the lower irrigation assembly 90 via the intake pipe 184, which distributes the liquid to the various piping structures of the upper piping arrangement 140 and the lower piping arrangement 92. The liquid escapes the upper piping arrangement 140 via the subsets of spray outlets 160, 162, 166, 168, and the liquid escapes the lower piping arrangement 92 via the spray outlets 102, 104, 106, 118, 120, 122. The liquid expelled by the first subsets of spray outlets 160, 166 passes through the slot opening 280 into the upper back interior portions (i.e., rear shoulder regions) of the wetsuit, and the liquid expelled by the second subsets of spray outlets 162, 168 passes through the slot opening 288 into the upper front interior portions (i.e., front shoulder regions) of the wetsuit. The liquid expelled by the first subset of spray outlets 102 of the first plurality of spray outlets 100 of the first curved pipe 94 passes through the first triangular opening 248. The liquid expelled by the second subset of spray outlets 104 of the first plurality of spray outlets 100 of the first curved pipe 94 passes through the second triangular opening 250. The liquid expelled by the first subset of spray outlets 118 of the first plurality of spray outlets 116 of the second curved pipe 108 passes through the first triangular opening 268. The liquid expelled by the second subset of spray outlets 120 of the first plurality of spray outlets 116 of the second curved pipe 108 passes through the second triangular opening 270.

According to certain embodiments, the liquid becomes pressurized as it flows through the irrigation assemblies 20, 90. In such embodiments, the pressure in the lower irrigation assembly is in the range of 1-3 bar. When the lower piping arrangement 92 reaches a fluid level sufficient to expel liquid from the spray outlets 100, 106, 116, 122, the pressure differential between the lower irrigation assembly 90 and the upper irrigation assembly 140 causes the liquid from the intake pipe 184 to simultaneously flow down to the upper piping arrangement 140, and up to the fluid chamber formed by the cover assembly 22 and the lower base plate 44. The pressure differential main intake port 26 and the intake pipe 184 acts to prevent liquid from flowing back out of the main intake port 26 from the irrigation assemblies 20, 90. Nevertheless, a check valve may be deployed at the main intake port 26 to further prevent such backflow.

Figure 32:
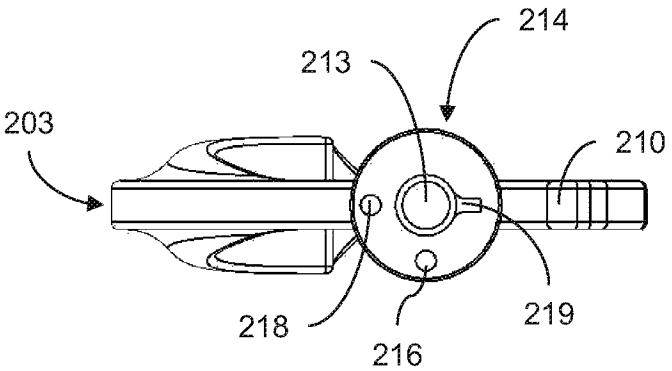
FIG. 32 is a bottom view of the hook assembly of FIG. 31.
Figure 31:
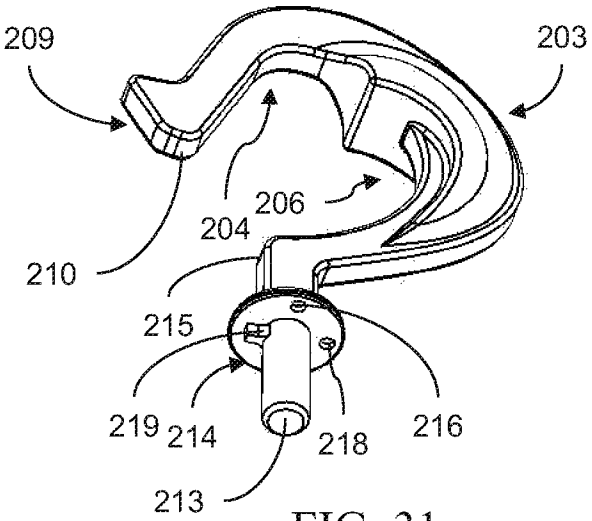
FIG. 31 is an isometric view of the hook assembly of FIG. 31, taken from below the hook assembly.
Figure 30:
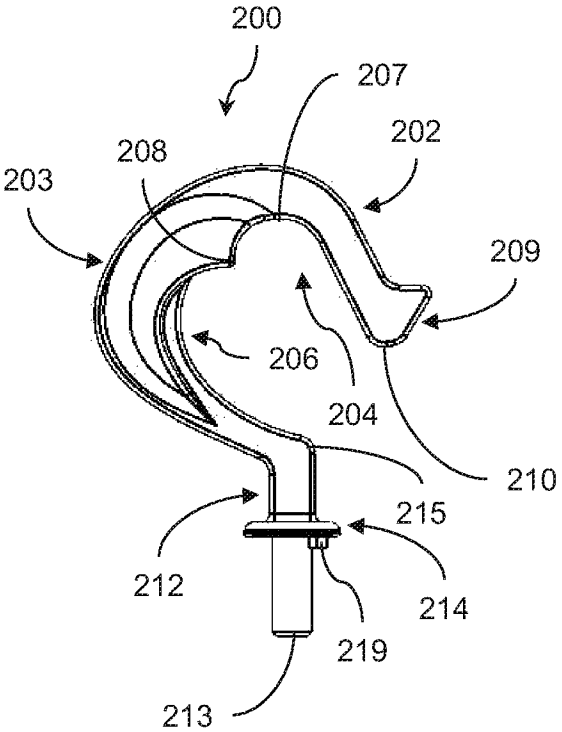
FIG. 30 is a front view of the hook assembly of the device of FIG. 1.

As mentioned above, the device 10 has a hook assembly 200 which is used to mount the device 10 to mounting structure, such as a rack, rope, metal line, or the like. Refer now to FIGS. 30-32, the hook assembly 200. The hook assembly 200 has a hook portion 202 with a rod 212 extending downwardly therefrom. A flange 214 extends outwardly from approximately the midpoint of the rod 212 such that the rod 212 and the flange 214 are coaxial. The flange 214 has two circular grooves, namely a first groove 216 and a second groove 218, disposed on a bottom portion of the flange 214. The two grooves 216, 218 are radially disposed from the central axis (i.e., longitudinal axis) of the rod 212 and an equal distance, and offset from each other by 90 degrees. A protruding element 219 protrudes outwardly from the rod 212 along the bottom surface of the flange 214. The protruding portion 219 extends outwardly in a direction opposite from the second groove 218.

Figure 7:
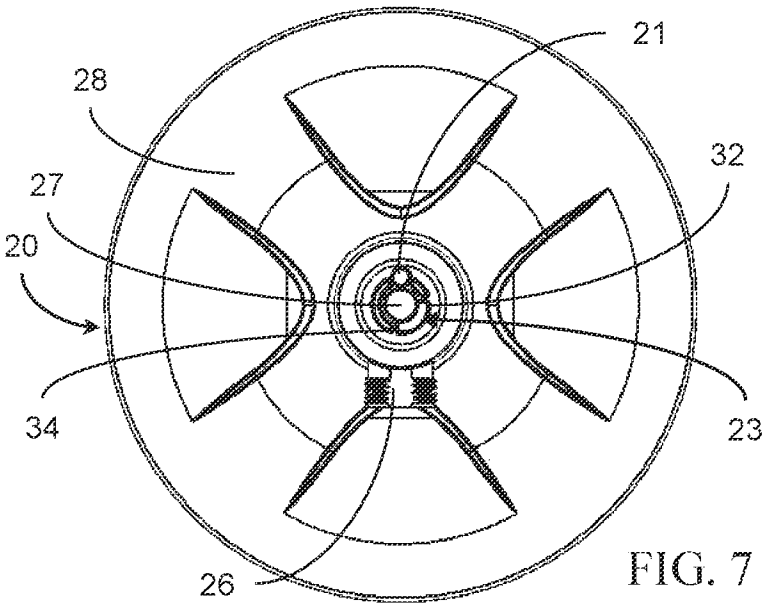
FIG. 7 is a top view of the upper irrigation assembly of FIG. 5.

The rod 212 extends into the cover assembly 22 through the connection port 27 of the cover assembly 22. The connection port 27 is deployed at an opening on the top side of the flute portion 24 at a terminating end of the flute portion 24. FIG. 7 shows a top view of the cover assembly 22, illustrating the connection port 27. Also disposed on the top side of the flute portion, peripheral to the connection port 27, is a plunger 21 and a groove path 23 having two terminal ends 32, 34. The plunger 21 and the grooves 216, 218 are correspondingly configured. The groove path 23 and the protruding portion 219 are also correspondingly configured.

The rod 212 is inserted into the connection port 27 such that a terminating end 213 of the rod 212 is deployed inside the flute portion 24 and the bottom surface of the flange 214 abuts the top side (i.e., terminating end) of the flute portion 24. When the rod 212 is inserted into the connection port 27, the protruding portion 219 fits in the groove path 23 and the plunger 21 is seated in (i.e., engaged with) one of the grooves 216, 218. The hook assembly 200 is rotatable between two positions about the axis of rotation of the rod 212, which is normal to the main plane of the planar annular flange 60. In a first rotation position (FIG. 1), the protruding portion 219 is positioned at a first terminal end 32 of the groove path 21, and the plunger 23 is seated in (i.e., engaged with) the first groove 216. The hook assembly 200 is rotated 90 degrees clockwise (in the reference frame shown in Fla 7) about the rotational axis of the rod 212 to a second rotation position. The rotation urges the protruding portion 219 to slide in the groove path 23 until reaching a second terminal end 34 of the groove path 23, at which point the plunger 21 becomes seated in (i.e., engaged with) the second groove 218.

Figure 13:
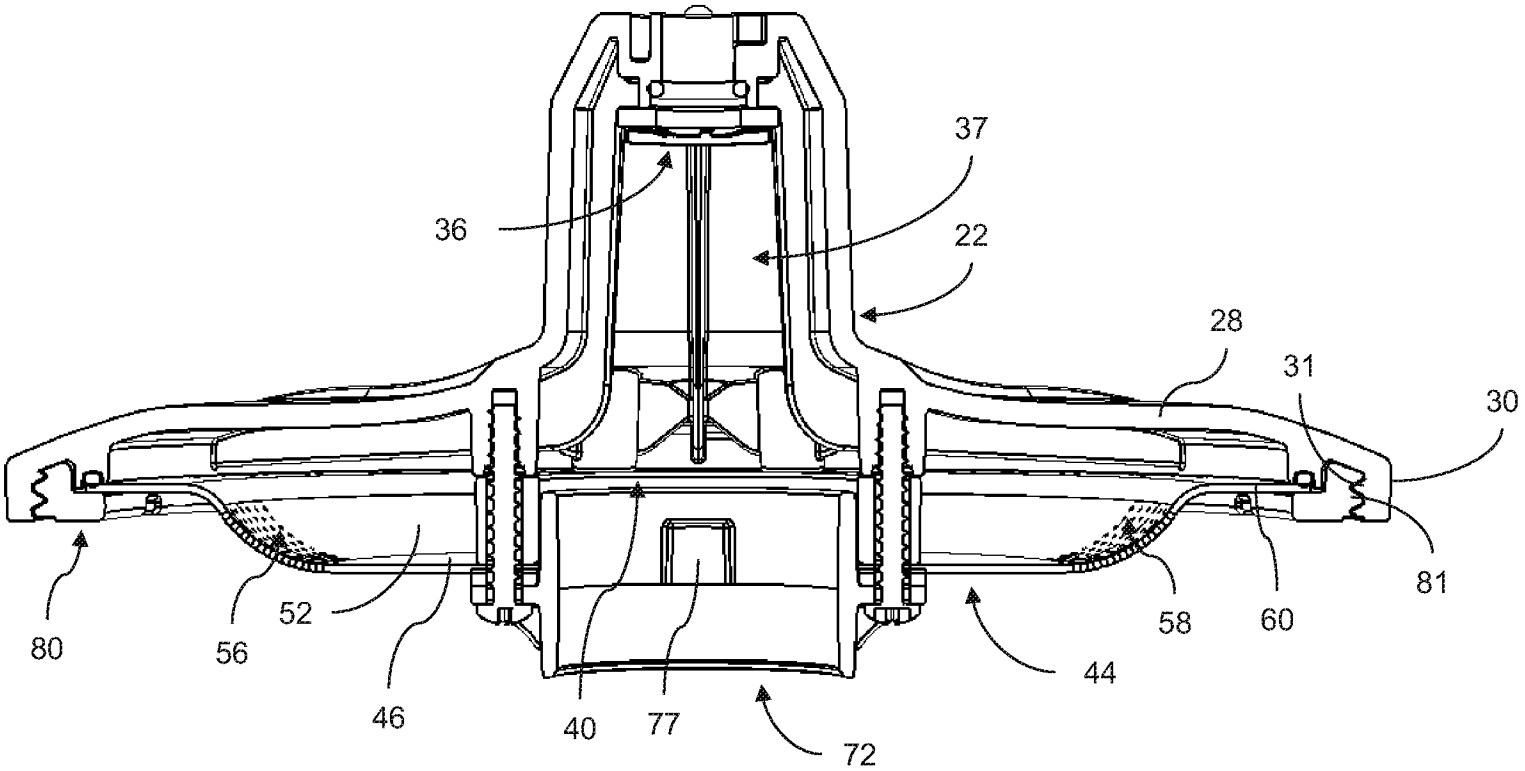
FIG. 13 is a perspective view of the upper irrigation assembly similar to FIG. 5, cut-away along a central plane of the upper irrigation assembly.
Figure 14:
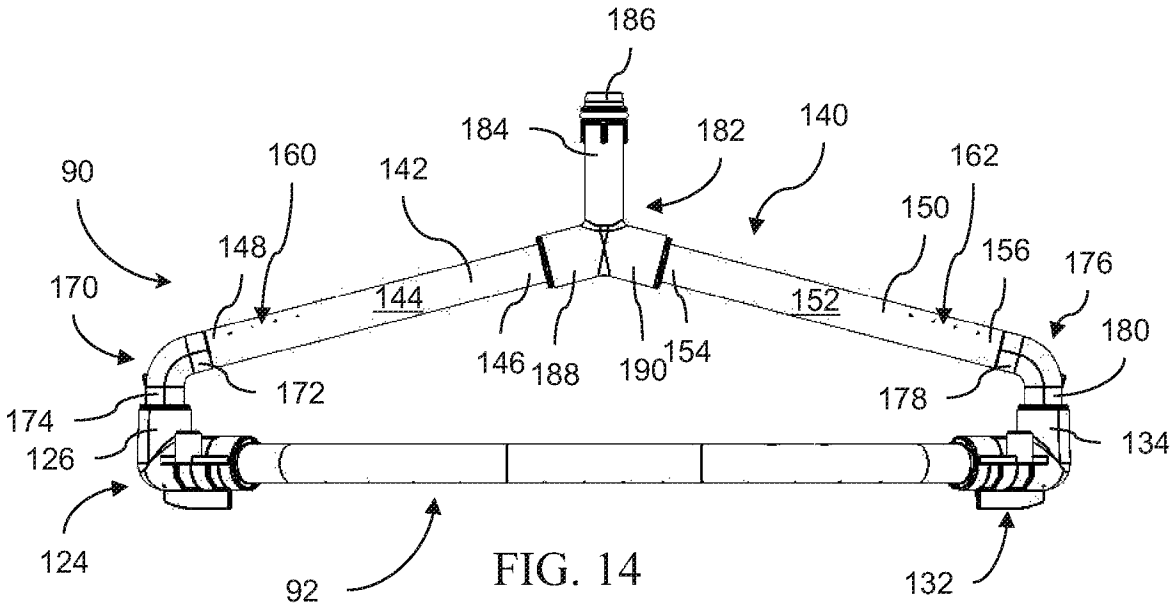
FIG. 14 is a front view the lower irrigation assembly of the device of FIG. 1.
Figure 15:
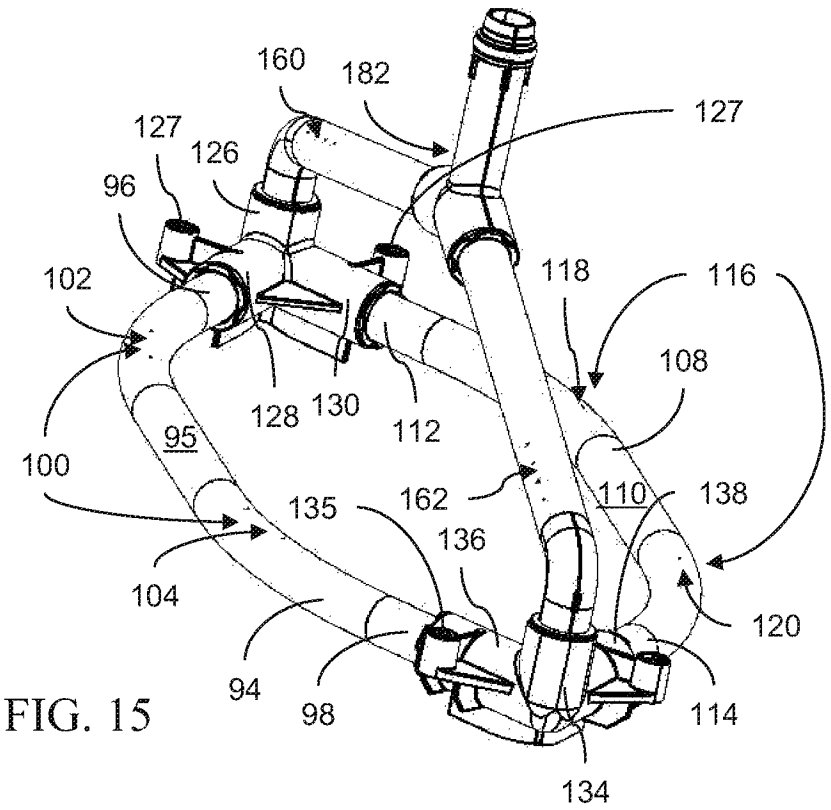
FIG. 15 is an isometric view of the lower irrigation assembly of FIG. 14, taken from above the lower irrigation assembly.
Figure 16:
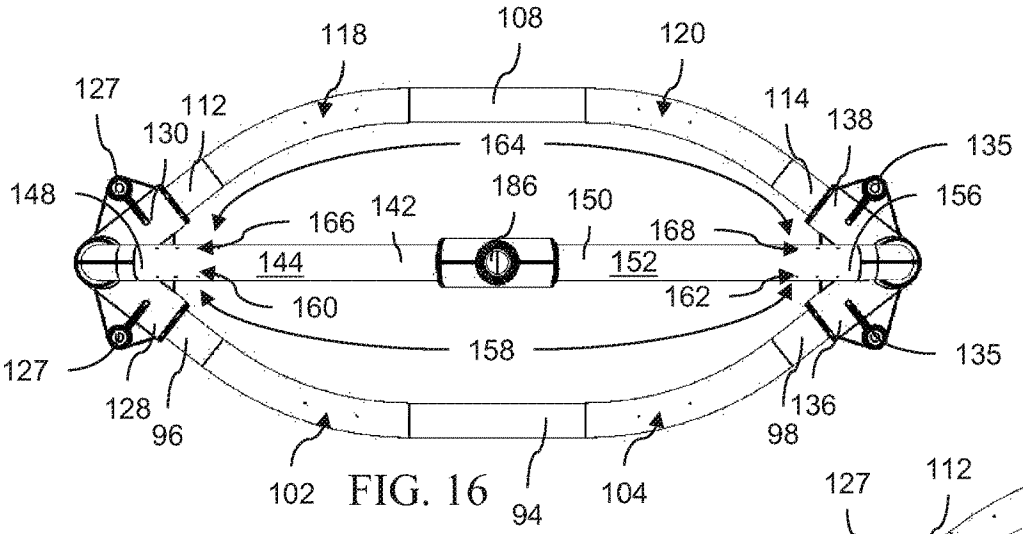
FIG. 16 is a top view of the lower irrigation assembly of FIG. 14.
Figure 17:
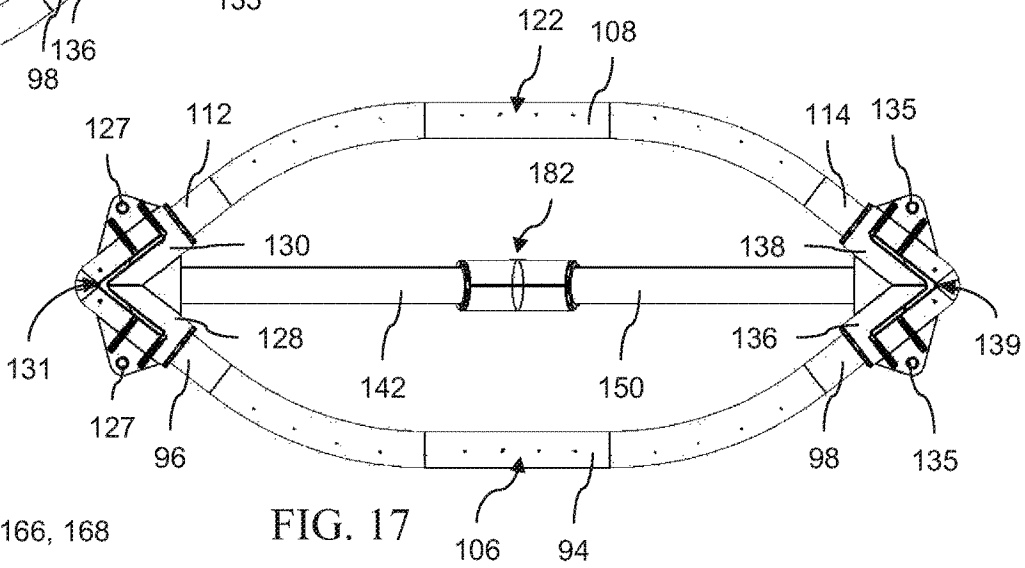
FIG. 17 is a bottom view of the lower irrigation assembly of FIG. 14.

A starlock washer 36, shown in the cut-away view illustrated in FIG. 13, is seated in the interior sidewall of the flute portion 24. The starlock washer 36 has a central opening that serves as part of the connection port 27, allowing the rod 212 to extend through the central opening of the starlock washer 36. The starlock washer 36 provides an attachment mechanism for securing the hook assembly 200 to the cover assembly 22.

The hook portion 202 is generally hook-shaped, and includes a hook tip 209 and two curved regions, namely a first curved region 204 and a second curved region 206. The hook tip 209 is aligned with the protruding portion 219 of the flange 214. As such, when the hook assembly 200 is in the first rotation position, the hook tip 209 is pointed toward the second shoulder portion 284, and when the hook assembly 200 is in the second rotation position, the hook tip 219 is pointed toward the main intake port 26.

Each of the curved regions 204, 206 has one or more curved interior surfaces. The first curved region 204 is bounded by the hook tip 209 and a flared ridge 208 that separates the two curved regions 204, 206. The second curved region 206 is hounded by the flared ridge 208 and a hook converging end 215 of the rod 212. A rear portion 203 of the hook extends well beyond the peripheral edge of the flange 214, and is positioned closer to the second groove 218 than to the protruding portion 219. The flared ridge 208 is positioned slightly beyond the peripheral edge of the flange 214, and is closer to the second groove 218 than to the protruding portion 219. The second curved region 206 has a curve peak 207 that is roughly aligned with the longitudinal axis of the rod 212.

The hook portion 202 is constructed to enable the device 10 to hang in a straight and balanced position, such that the main planes of the irrigation assemblies 20, 90 (i.e., the main planes of the planar annular flange 60 and the central planar circular portion 46, and the main plane of the ellipse formed by the lower piping arrangement 92) are parallel to the ground when the device 10 is mounted to a support structure (e.g., a taut rope or line, rod, cable, etc.). When a liquid supply conduit (i.e., hose) is connected to the main intake port 26, the center of gravity of the device 10 is shifted, and the hook portion 202 hangs with the support structure (i.e., rope) in the curve peak 207 of the second curved region 206, thereby allowing the device 10 (with the mounted wetsuit and the liquid source conduit connected) to hang in the straight and balanced position.

The hook tip 209 has a blunt bottom edge 210 which allows the device 10 to hang from a flat surface when not in use. For example, when the liquid source conduit is disconnected and no wetsuits are mounted to the main body 200, the device 10 can be positioned with the blunt bottom edge 210 on an edge of a flat surface (e.g., table top, counter top, etc.) to hang from the flat surface.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

As used herein, the singular form, "a", "an" and "the" include plural references unless the context clearly dictates otherwise.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A device for washing a wetsuit, comprising:

a first irrigation assembly for providing a liquid to exterior portions of the wetsuit and including a base plate having an upwardly curved sidewall and a planar annular peripheral flange, the upwardly curved sidewall including a plurality of spray outlets arranged to provide spray of the liquid to the exterior portions of the wetsuit at a plurality of spray angles, and the annular peripheral flange including a plurality of spray outlets arranged to provide spray of the liquid to the exterior portions of the wetsuit at spray angles different from the spray angles of the spray outlets of the upwardly curved sidewall; and a second irrigation assembly in fluid flow communication with the first irrigation assembly for providing the liquid to interior portions of the wetsuit, the second irrigation assembly including a first curved pipe having a major external surface, a second curved pipe having a major external surface, and an upper piping arrangement having a major external surface, the curved pipes and the upper piping arrangement being in fluid flow communication with each other via a first flow junction and a second flow junction, the second irrigation assembly further including a plurality of spray outlets arranged along the major external surfaces of the curved pipes and the upper piping arrangement and adapted to provide spray of the liquid, at a plurality of spray angles, to an upper rear interior portion of the wetsuit and a lower rear interior portion of the wetsuit, and to an upper front interior portion of the wetsuit and a lower front interior portion of the wetsuit.

2. The device of claim 1, wherein the curved pipes are operatively coupled to each other via respective first ends at the first flow junction and via respective second ends at the second flow junction.

3. The device of claim 1, wherein the curved pipes are operatively coupled to each other to form a substantially elliptical piping structure.

4. The device of claim 1, wherein the first curved pipe includes at least one segment that extends along a segment of the upper rear interior portion of the wetsuit, and wherein the second curved pipe includes at least one segment that extends along a segment of the upper front interior portion of the wetsuit.

5. The device of claim 1, wherein the first irrigation assembly further includes a cover assembly including an upper base plate operatively coupled to the base plate.

6. The device of claim 5, wherein the cover assembly further includes a neck portion having a main intake port for receiving the liquid to be supplied to the first and second irrigation assemblies.

7. The device of claim 1, further comprising a hook assembly that includes a hook and a rod, wherein the hook assembly is placed into communication with the first irrigation assembly via operative coupling of the rod and a connection port of the first irrigation assembly.

8. The device of claim 7, wherein the rod is rotatable, between two fixed rotation positions, about an axis of rotation that is normal to the plane of the planar annular peripheral flange.

9. The device of claim 7, wherein the hook includes a first curved interior surface and a second curved interior surface, the first and second curved interior surfaces being separated by a flared ridge.

10. The device of claim 9, wherein the second curved interior surface extends between the flared tip and a blunt edge, wherein a tip of the hook is terminated by the blunt edge.

11. The device of claim 1, further comprising a main body deployed to cover the second irrigation assembly, the main body including a plurality of major external surfaces that together conform in shape to the upper chest, shoulder, upper back, and lower neck portions of a human body.

12. A device for washing a wetsuit, comprising:

a first curved pipe having a major external surface and including a first plurality of spray outlets and second plurality of spray outlets, the first plurality of spray outlets arranged along an upper portion of the major external surface and adapted to provide spray of a liquid to an upper rear interior portion of the wetsuit, the second plurality of spray outlets arranged along a lower portion of the major external surface and adapted to provide spray of the liquid to a lower rear interior portion of the wetsuit;

a second curved pipe having a major external surface and including a first plurality of spray outlets and a second plurality of spray outlets, the curved pipes being operatively coupled to each other at a first flow junction and a second flow junction, the first plurality of spray outlets arranged along an upper portion of the major external surface and adapted to provide spray of the liquid to an upper front interior portion of the wetsuit, the second plurality of spray outlets arranged along a lower portion of the major external surface and adapted to provide spray of the liquid to a lower front interior portion of the wetsuit;

an upper piping arrangement including at least one pipe segment operatively coupled to the curved pipes at the first and second flow junctions, the first and second flow junctions placing the curved pipes and the upper piping arrangement in fluid flow communication with each other, the upper piping arrangement including a first plurality of spray outlets arranged along the at least one pipe segment and adapted to provide spray of the liquid to the upper rear interior portion of the wetsuit and a second plurality of spray outlets arranged along the at least one pipe segment and adapted to provide spray of the liquid to the upper front interior portion of the wetsuit; and a base plate in fluid flow communication with the upper piping arrangement, the base plate having an upwardly curved sidewall and an annular peripheral flange, the upwardly curved sidewall including a plurality of spray outlets arranged to provide spray of the liquid to exterior portions of the wetsuit at a plurality of spray angles, and the annular peripheral flange including a plurality of spray outlets arranged to provide spray of the liquid to exterior portions of the wetsuit at spray angles different from the spray angles of the spray outlets of the upwardly curved sidewall.

13. The device of claim 12, wherein the upper piping arrangement includes an intake port for receiving the liquid to be supplied to the at least one pipe segment and the curved pipes, and wherein the liquid flows through the intake port to the at least one pipe segment and subsequently to the curved pipes.

14. The device of claim 12, further comprising: a main intake port in fluid flow communication with the base plate for receiving the liquid to be supplied to the pluralities of spray outlets of the curved pipes, upper piping arrangement, and base plate.

15. The device of claim 12, further comprising: a main body deployed to cover segments of the curved pipes and the upper piping arrangement.

16. The device of claim 15, wherein the main body includes a first shoulder portion and a second shoulder portion, each of the shoulder portions formed from at least one major external surface and a slot opening, wherein the slot opening of the first shoulder portion is deployed proximate to the first flow junction to allow the liquid to spray out of a subset of the spray outlets of the first plurality of spray outlets of the first and second curved pipes through the slot opening of the first shoulder portion, and wherein the slot opening of the second shoulder portion is deployed proximate to the second flow junction to allow the liquid to spray out of a subset of the spray outlets of the second plurality of spray outlets of the first and second curved pipes through the slot opening of the second shoulder portion.

17. A device for washing a wetsuit, comprising:

a lower irrigation assembly for providing a liquid to interior portions of the wetsuit, the lower irrigation assembly including a first curved pipe, a second curved pipe, and an upper piping arrangement having at least one pipe segment, the curved pipes and the upper piping arrangement being in fluid flow communication with each other via a first flow junction and a second flow junction, the lower irrigation assembly further including a plurality of spray outlets arranged along major external surfaces of the curved pipes and the at least one pipe segment of the upper piping arrangement; and a main body operatively coupled to the lower irrigation assembly, the main body including a first shoulder portion and a second shoulder portion, each of the shoulder portions formed from at least one major external surface and a slot opening, wherein the slot opening of the first shoulder portion is deployed proximate to the first flow junction to allow the liquid to spray out of a first subset of the plurality of spray outlets arranged along an upper portion of the major external surface of the at least one pipe segment of the upper piping arrangement through the slot opening of the first shoulder portion, and wherein the slot opening of the second shoulder portion is deployed proximate to the second flow junction to allow the liquid to spray out of a second subset of the plurality of spray outlets arranged along an upper portion of the major external surface of the at least one pipe segment of the upper piping arrangement through the slot opening of the second shoulder portion.

18. The device of claim 17, further comprising: an upper irrigation assembly in fluid flow communication with the lower irrigation assembly and including a base plate having an upwardly curved sidewall and a planar annular peripheral flange, the upwardly curved sidewall including a plurality of spray outlets arranged to provide spray of the liquid to exterior portions of the wetsuit at a plurality of spray angles, and the annular peripheral flange including a plurality of spray outlets arranged to provide spray of the liquid to exterior portions of the wetsuit at spray angles different from the spray angles of the spray outlets of the upwardly curved sidewall.

* * * * *